US009903050B2

(12) United States Patent
Forward et al.

(10) Patent No.: US 9,903,050 B2
(45) Date of Patent: Feb. 27, 2018

(54) FORMATION OF CORE-SHELL FIBERS AND PARTICLES BY FREE SURFACE ELECTROSPINNING

(71) Applicant: Massachusetts Institute of Technology, Cambridge, MA (US)

(72) Inventors: Keith M. Forward, Riverside, CA (US); Gregory C. Rutledge, Newton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 356 days.

(21) Appl. No.: 14/438,650

(22) PCT Filed: Nov. 6, 2013

(86) PCT No.: PCT/US2013/068667
§ 371 (c)(1),
(2) Date: Apr. 27, 2015

(87) PCT Pub. No.: WO2014/074565
PCT Pub. Date: May 15, 2014

(65) Prior Publication Data

US 2015/0308015 A1 Oct. 29, 2015

Related U.S. Application Data

(60) Provisional application No. 61/723,499, filed on Nov. 7, 2012.

(51) Int. Cl.
*D01F 8/04* (2006.01)
*D01D 5/00* (2006.01)
(Continued)

(52) U.S. Cl.
CPC ..... *D01D 5/0061* (2013.01); *D01D 5/0023* (2013.01); *D01D 5/0069* (2013.01);
(Continued)

(58) Field of Classification Search
CPC .. D01D 5/0007; D01D 5/0015; D01D 5/0023; D01D 5/003; D01D 5/0038;
(Continued)

(56) References Cited

U.S. PATENT DOCUMENTS 4,673,402 A 6/1987 Weisman et al.
2010/0001438 A1 1/2010 Kishimoto
(Continued)

FOREIGN PATENT DOCUMENTS

EP 0 197 493 A2 10/1986
EP 2 045 375 A1 4/2009
WO WO-2008/106904 A1 9/2008
WO WO-2012/017218 A2 2/2012

OTHER PUBLICATIONS

International Search Report dated Feb. 27, 2014, from PCT/US2013/068667.
(Continued)

*Primary Examiner* — Leo B Tentoni
(74) *Attorney, Agent, or Firm* — Foley Hoag LLP; Dana M. Gordon

(57) ABSTRACT

Disclosed are methods that utilize the differences in physical properties between two coating fluids to form core-shell particles or core-shell fibers by coaxial free-surface electrospinning. The methods are able to achieve higher productivity than known methods, and are tunable. Nonwoven fiber mats of electrospun fibers have garnered much scientific and commercial interest in recent years due to their unique properties, such as their high porosity, high surface area and small diameter fibers.

21 Claims, 18 Drawing Sheets

(51) Int. Cl.
*D01D 5/34* (2006.01)
*D01F 8/16* (2006.01)
*D04H 1/728* (2012.01)

(52) U.S. Cl.
CPC ..... *D01D 5/0076* (2013.01); *D01D 5/0084* (2013.01); *D01D 5/34* (2013.01); *D01F 8/16* (2013.01); *D04H 1/728* (2013.01); *D10B 2321/00* (2013.01); *D10B 2331/06* (2013.01)

(58) Field of Classification Search
CPC .. D01D 5/0046; D01D 5/0069; D01D 5/0076; D01D 5/0084; D01D 5/34; D01F 8/04
USPC ..... 264/10, 172.15, 464, 465, 466, 484
See application file for complete search history.

(56) References Cited

U.S. PATENT DOCUMENTS

2014/0103583 A1* 4/2014 Pham ..... D01D 5/0069 264/465
2014/0128345 A1* 5/2014 Woodrow ..... D01D 5/0007 264/484 X

OTHER PUBLICATIONS

Kim et al., "Controlled Array of Ferritin in Tubular Nanostructure," Macromolecular Rapid Communications, 29:552-556 (2008).
Sahay et al., "Design Modifications in Electrospinning Setup for Advanced Applications," Journal of Nanomaterials, 317673 (2011).

* cited by examiner

| Top fluid | $Ca_T/Ca_B$ | $\nu_B$ | $\varepsilon_\infty^{theor}$ | $\varepsilon_\infty^{exp}$ | Fiber diameter (nm) |
|---|---|---|---|---|---|
| 10 wt% PS | 0.0020 | 0.80 | 0.92 | 0.81 ± 0.02 | 440 ± 130 |
| 20 wt% PS | 0.0074 | 0.75 | 0.82 | 0.71 ± 0.10 | 430 ± 130 |
| 30 wt% PS | 0.030 | 0.68 | 0.70 | 0.65 ± 0.05 | 520 ± 160 |

Figure 10

| PS molar mass, concentration, $C_T$ | Solvent composition[a] | Density, $\rho_T$ (g/mL) | Conductivity (μS/cm) | Viscosity @ 0 $s^{-1}$ (mPa s) | Surface tension[i] (mN m) | Interfacial tension with water[ii] (mN m) |
|---|---|---|---|---|---|---|
| 35 kDa, 10 wt% | 0:100 | 0.89 | <0.01 | 3.0 | 28.1 | 39.5 |
| | 10:90 | 0.88 | <0.01 | 3.0 | 27.8 | 14.6 |
| | 20:80 | 0.88 | <0.01 | 3.0 | 27.4 | 12.3 |
| | 35:65 | 0.87 | <0.01 | 2.8 | 26.6 | 8.5 |
| 35 kDa, 20 wt% | 0:100 | 0.92 | <0.01 | 11 | 28.1 | 39.5 |
| | 10:90 | 0.91 | <0.01 | 11 | 27.8 | 14.6 |
| | 20:80 | 0.91 | <0.01 | 11 | 27.4 | 12.3 |
| | 35:65 | 0.90 | <0.01 | 10 | 26.6 | 8.5 |
| 35 kDa, 30 wt% | 0:100 | 0.93 | <0.01 | 44 | 28.1 | 39.5 |
| | 10:90 | 0.92 | <0.01 | 44 | 27.8 | 14.6 |
| | 20:80 | 0.92 | <0.01 | 43 | 27.4 | 12.3 |
| | 35:65 | 0.92 | <0.01 | 42 | 26.6 | 8.5 |
| 35 kDa, 35 wt% | 35:65 | 0.95 | <0.01 | 100 | 26.6 | 8.5 |
| 35 kDa, 40 wt% | 35:65 | 0.97 | <0.01 | 190 | 26.6 | 8.5 |

Figure 11

| Solute, molar mass, Concentration, $C_B$ | Solvent | Density, $\rho_B$ (g/mL) | Conductivity (μS/cm) | Viscosity @ 200 $s^{-1}$ (mPa s) |
|---|---|---|---|---|
| PEG, 35 kDa, 8.25 wt% PEO, 300 kDa, 3.75 wt% | Water | 1.04 | 76.7 | 330 |
| PVP, 360 kDa, 15 wt% | Water | 1.04 | 6.8 | 550 |
| PVP, 1.3 MDa, 8 wt% | Water | 1.02 | 7.3 | 90 |

Figure 12

| Bottom Solution | Top Solutions |
|---|---|
| 12 wt% (8.25 wt% 35 kDa PEG and 3.24 wt% 300kDa PEO) in DI water | 10, 20, 30, 35, 45 wt% 35 kDa PS in 35:65wt n-Butanol:Mesitylene |
| | 30, 35, 40 wt% 35 kDa in 20:80wt in n-Butanol:Mesitylene |
| | 10, 20, 30 wt% 35 kDa in 20:80wt in n-Propanol:Mesitylene |
| | 10 wt% EC in 75:25 n-Butanol:Mesitylene |
| | 10 wt% EC in 90:10 n-Butanol:Mesitylene |
| | 10 wt% EC in 35:65 n-Butanol:Amylbenzene |
| | 10 wt% EC in 50:50 n-Butanol:Amylbenzene |
| | 10 wt% EC in 35:65 n-Butanol:Hexylbenzene |
| | 10 wt% EC in 50:50 n-Butanol: Hexylbenzene |
| | 10 wt% EC in 75:25 n-Butanol: Hexylbenzene |

Figure 13

| Bottom Solution | Top Solutions |
|---|---|
| 15 wt% 360 kDa PVP | 5, 10, 20, 30 wt% 35 kDa PS in 35:65wt n-Butanol:Mesitylene |
| | 30, 35, 40 wt% 35 kDa in 20:80wt in n-Butanol:Mesitylene |

Figure 14

| Bottom Solution | Top Solutions |
|---|---|
| 15 wt% 360 kDa PVP with 5wt% of Acetaminophen in DI water | 15, 12, 10, 7 wt% EC in 50:50wt n-Butanol:Amylbenzene |

Figure 15

| Bottom Solution | Top Solutions |
|---|---|
| 5 wt% 300 kDa PEO in DI water | 10 wt% EC in 50:50wt n-Butanol:Amylbenzene |
| | 10 wt% EC in 50:50wt n-Butanol:Mesitylene |
| | 10 wt% EC in 50:50wt n-Butanol:Hexylbenzene |

Figure 16

| Electrode | Result |
|---|---|
| **Straight parallel wires** | |
| 28 gauge copper wire (0.32 mm diameter) | Co-axial fibers |
| 32 gauge copper wire (0.20 mm diameter) | Co-axial fibers |
| 32 gauge stainless steel wire (0.20 mm diameter) | Co-axial fibers |
| **Helix wire** | |
| 28 gauge copper wire (0.32 mm diameter) | Co-axial fibers |
| 32 gauge copper wire (0.20 mm diameter) | Co-axial fibers |

Figure 20

| Input variable | Value |
|---|---|
| Initial jet radius ratio, $\varepsilon_{j0}$ | 0.85 |
| Initial composition of organic solvent (n-butanol:mesitylene) | 20:80 wt% |
| Solute concentration in | |
| top fluid (polystyrene, 35kDa) | 20 wt% |
| bottom fluid (polyethylene glycol, 35 kDa and polyethylene oxide, 300 kDa, 73:27 wt% mixture) | 12 wt% |
| Density of solution | |
| top fluid | 910 kg/m$^3$ |
| bottom fluid | 1040 kg/m$^3$ |
| Density of solidified polymer | |
| top solute (polystyrene) | 1050 kg/m$^3$ |
| bottom solute (polyethylene glycol, 35 kDa and polyethylene oxide, 300 kDa, 73:27 wt% mixture) | 1150 kg/m$^3$ |

Figure 21

| Set variable | Value |
|---|---|
| Temperature | 25 °C |
| Pressure | 101 kPa |
| Kinematic viscosity of air | 0.15 x 10$^{-6}$m$^2$/s |
| Relative humidity | 0% |
| initial outer jet diameter | 1 µm |
| Jet velocity | 1 m/s |
| Diffusion coefficient | |
| *n*-butanol in air | 0.80 x 10$^{-5}$ m$^2$/s |
| mesitylene in air | 0.62 x 10$^{-5}$ m$^2$/s |
| water in air | 2.82 x 10$^{-5}$ m$^2$/s |
| water in organic shell | 1.0 x 10$^{-9}$ m$^2$/s |
| Density of solvent | |
| *n*-butanol | 810 kg/m$^3$ |
| mesitylene | 864 kg/m$^3$ |
| water | 1000 kg/m$^3$ |
| Saturated vapor pressure at 25 °C | |
| *n*-butanol | 820 Pa |
| mesitylene | 320 Pa |
| water | 3100 Pa |

core-shell particles_9.tif
Print Mag: 164000x @ 51 mm
11:40 10/09/13

20 nm
HV = 200kV
Direct Mag: 100000x core-shell particles_8.tif
Print Mag: 164000x @ 51 mm
11:38 10/09/13

20 nm
HV = 200kV
Direct Mag: 100000x

FORMATION OF CORE-SHELL FIBERS AND PARTICLES BY FREE SURFACE ELECTROSPINNING

RELATED APPLICATIONS

This application is the National Stage application of PCT/US13/068667, filed Nov. 6, 2013, which claims the benefit of priority to U.S. Provisional Patent Application Ser. No. 61/723,499, filed Nov. 7, 2012.

BACKGROUND

Nonwoven fiber mats of electrospun fibers have garnered much scientific and commercial interest in recent years due to their unique properties, such as their high porosity, high surface area and small diameter fibers. These fibers have implications in a broad range of fields, including drug delivery, filtration, tissue engineering, nanocomposites, textiles and alternative-energy generation systems such as solar cells, fuel cells, and energy storage devices. Electrospun fibers with core-shell (or "core-sheath") morphology comprise an important subset of these materials, characterized by distinct interior and exterior compositions, including hollow fibers.

Electrospun core-shell fibers are produced conventionally by a method called coaxial electrospinning (also called "two-fluid electrospinning"), a simple technique that employs two concentric spinnerets to produce core-shell fibers ranging from hundreds of nanometers to tens of microns in diameter. However, one of the major drawbacks of the conventional process is limited productivity, typically around 0.001 to 0.1 g/h per spinneret. Attempts to develop multi-spinneret configurations have been unsuccessful in producing uniform mats and fibers. A number of alternative system configurations have been proposed in which electrohydrodynamic (EHD) jets are emitted directly from a free liquid surface instead of the meniscus formed at a spinneret. These configurations go by various names, including "needle-less" electrospinning and "bubble" electrospinning and differ in the manner by which a jet is caused to be emitted from the surface of a charged liquid bath, collectively "free surface electrospinning." Free surface electrospinning has been shown to be capable of producing electrospun fibers at rates that are two to three orders of magnitude higher than spinneret-based methods while maintaining uniformity in the fiber diameter and electrospun mat. However, due to the nature of EHD jets forming from a free liquid surface, it has proven difficult to produce core-shell electrospun fibers by any of the free surface electrospinning techniques.

There exists a need for a method of producing electrospun fibers with core-shell morphology by means of free surface electrospinning from a coated wire.

SUMMARY

In certain embodiments, the invention relates to a method of forming a plurality of core-shell particles or a plurality of core-shell fibers, comprising the steps of:

applying an electric voltage to a cylindrical electrode;

drawing the cylindrical electrode through a first fluid, thereby forming a coated cylindrical electrode;

drawing the coated cylindrical electrode through a second fluid, wherein the first fluid is more viscous than the second fluid, thereby forming a bilayer-coated cylindrical electrode; and positioning the bilayer-coated cylindrical electrode at a distance from a grounded collection surface;

wherein the plurality of core-shell particles or the plurality of core-shell fibers is deposited on the grounded collection surface.

In certain embodiments, the invention relates to any one of the aforementioned methods, wherein the density of the first fluid is greater than the density of the second fluid.

In certain embodiments, the invention relates to any one of the aforementioned methods, wherein the dielectric constant of the first fluid is greater than the dielectric constant of the second fluid.

In certain embodiments, the invention relates to any one of the aforementioned methods, wherein the electrical conductivity of the first fluid is greater than the electrical conductivity of the second fluid.

In certain embodiments, the invention relates to a core-shell particle or a core-shell fiber made by any one of the aforementioned methods.

In certain embodiments, the invention relates to a core-shell fiber made by any one of the aforementioned methods.

In certain embodiments, the invention relates to a nonwoven material comprising a plurality of core-shell fibers made by any one of the aforementioned methods.

BRIEF DESCRIPTION OF THE FIGURES

FIG. 10 tabulates solution properties of tested top solutions. (i) C. Pan, G. Ouyang, J. Lin, T. Rai, X. Zhen, G. Lu, Z. Huang, Excess Molar Volumes and Surface Tensions of 1,2,4-Trimethylbenzene and 1,3,5-Trimethylbenzene with 1-Butanol, 2-Methyl-1-propanol, 2-Butanol, and 2-Methyl-2-propanol at 298.15 K, *J. Chem. Eng. Data* 2004, 49, 1744-1747. (ii) D. J. Donahue, F. E. Bartell, The Boundary Tension at Water-Organic Liquid Interface, *J. Phys. Chem.*, 1952, 56, 480-484. [a]expressed in parts by weight of n-butanol and mesitylene in the solvent.

FIG. 11 tabulates solution properties of various bottom solutions.

FIG. 12 tabulates different combinations of bottom solutions and top solutions to produce core-shell structures. PVP=Polyvinylpyrrolidone; PEG=Polyethylene glycol; PEO=Polyethylene oxide; PS=polystyrene; EC=ethyl cellulose (4 cP, 5 wt % in toluene/ethanol 80:20, extent of labeling: 48% ethoxyl)

FIG. 13 tabulates different combinations of bottom solutions and top solutions to produce core-shell structures. PVP=Polyvinylpyrrolidone; PEG=Polyethylene glycol; PEO=Polyethylene oxide; PS=polystyrene; EC=ethyl cellulose (4 cP, 5 wt % in toluene/ethanol 80:20, extent of labeling: 48% ethoxyl)

FIG. 14 tabulates different combinations of bottom solutions and top solutions to produce core-shell structures. PVP=Polyvinylpyrrolidone; PEG=Polyethylene glycol; PEO=Polyethylene oxide; PS=polystyrene; EC=ethyl cellulose (4 cP, 5 wt % in toluene/ethanol 80:20, extent of labeling: 48% ethoxyl)

FIG. 15 tabulates different combinations of bottom solutions and top solutions to produce core-shell structures. PVP=Polyvinylpyrrolidone; PEG=Polyethylene glycol; PEO=Polyethylene oxide; PS=polystyrene; EC=ethyl cellulose (4 cP, 5 wt % in toluene/ethanol 80:20, extent of labeling: 48% ethoxyl)

FIG. 16 tabulates the results associated with different electrode shapes.

FIG. 20 tabulates exemplary input variables for a system in which the top liquid is 20 wt % PS in a mixed solvent (20:80 wt % n-butanoh:mesitylene) and the bottom liquid is 12 wt % PEG+PEO (73:27 wt % mixture) in DI water.

FIG. 21 tabulates variables for the mass transfer model.

DETAILED DESCRIPTION

Overview

Figure 1:
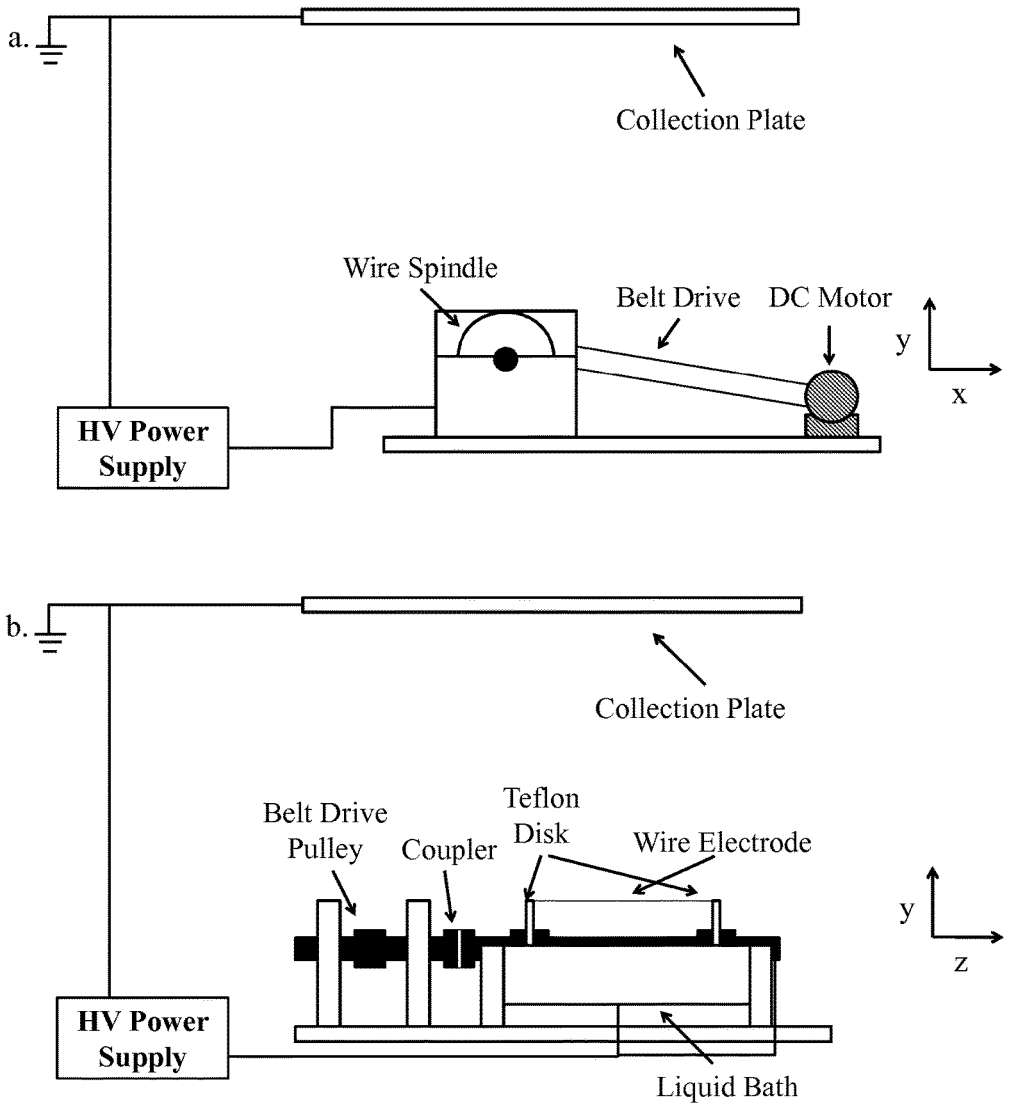
FIG. 1 depicts an apparatus for free surface electrospinning from wire electrodes. The liquid bath and wire spindle are connected to a high voltage power supply and the collection plate is connected to ground. (a) side view, parallel to spindle axis; (b) front view, perpendicular to spindle axis.

In certain embodiments, the invention relates to a method of coaxial free surface electrospinning. In certain embodiments, metal wire electrodes (e.g., 200 microns in diameter) are mounted on a spindle and drawn through a liquid bath containing two immiscible liquids, one layered on top of the other. The wire may be drawn through the bath in such a way that its axis is oriented either perpendicular or parallel to the liquid surface, or any angle in between. FIG. 1 shows a diagram of the free surface electrospinning apparatus.

Simulations have been performed to investigate the behavior of a rigid sphere passing through a deformable interface between two fluids. These simulations showed than the amount of fluid entrained on the sphere is primarily dependent on the viscosity ratio of the two fluids, $\lambda=\eta_T/\eta_B$ (where $\eta_T$ and $\eta_B$ are viscosities of the "top" fluid and the "bottom" fluid, respectively) and somewhat less strongly dependent on the capillary number, $Ca=u\eta_B/\gamma$ (where u and $\gamma$ are the velocity of sphere and interfacial tension, respectively). When $\lambda$ is much larger than unity, the bottom fluid experiences negligible viscous force to keep it entrained on the surface of the sphere, so it drains off the rigid surface, leaving only the top viscous fluid to coat the rigid surface. When $\lambda$ is much smaller than unity, the top fluid experiences negligible viscous force (compared to the bottom fluid) to keep it entrained on the surface of the sphere, leaving only the bottom fluid to coat the rigid surface. When two or more fluids are arranged in layers, the condition must be checked at each deformable interface. Thus, for two fluids, $\eta_B>\eta_T>\eta_{air}$ is expected to result in the entrainment of both fluids on the rigid sphere.

When a cylinder is drawn through a deformable interface, the thickness of an annular film of entrained fluid, h, is a function of the capillary number ($Ca=u\eta/\gamma$) of the liquid, according to the relationship $h\sim Ca^b$. For the case where the axis of the wire is oriented perpendicular to the liquid surface, the thickness of the entrained film is expected to follow the relation of Landau, Levich, and Derjaguin, in which $b=0.67$[19], while for the case where the axis of the wire is oriented parallel to the liquid surface, we have previously found empirically that $b=0.22$[17].

After exiting the bath, the entrained annular film on the wire experiences a Plateau-Rayleigh instability, which causes the film to break up into drops along the wire. The rate at which the film breaks up into drops is governed by the most rapidly growing disturbance. Goren's analysis predicts that a thin monolayer film whose thickness is less than half of the characteristic length scale breaks up at a constant rate.

In the presence of an electric field, the drops orient themselves toward the downfield side of the electrode wire and deform into individual Taylor cones. At a critical electric field strength, jetting of the liquid from the drop initiates, resulting in processes commonly known as electrospraying or electrospinning. As the jet travels towards the grounded collection surface, the jet stretches and thins due to electric field stresses and charge repulsion. Several well-known fluid instabilities can occur in the jet. One of these, an axially symmetric varicose instability, leads to break up of the jet into aerosolized droplets. As the viscoelasticity of the fluids increases, this axially symmetric instability becomes dominated by an asymmetric whipping instability that leads to further stretching of the jet into the submicrometer diameter range. To produce solid particles or fibers, the fluids used are typically solutions consisting of a volatile solvent and one or more nonvolatile solutes. Evaporation of solvent results in the production of solid particles (electrospraying) or solid fibers (electrospinning).

Electrospraying is a technique in which a liquid is atomized under the application of a high electric potential. Conventionally, electrospraying is carried out in a similar way to electrospinning. A solution is pushed through a metal needle tip which is biased with a high electric potential. The liquid forms a Taylor cone at the end of the needle tip under the application of a sufficiently high electric field and undergoes disintegration into tiny droplets. These droplets get dried during their flight time towards the grounded collector and are deposited as solid particles. The size of these particles can be of the order of tens of nanometers.

In certain embodiments, the invention relates to electrosprayed core-shell particles. In certain embodiments, concentric needle tips are used to feed two fluids to form a co-axial jetting stream. However, similar to electrospinning, the major drawback of conventional electrospraying is its low production rate. In order to overcome the drawbacks of conventional electrospraying, in certain embodiments, the invention relates to a free-surface electrospraying technique to produce core-shell particles.

In certain embodiments, in this free-surface electroprocessing technique, multiple jetting is promoted simultaneously from a sufficiently large area of liquid surface. It involves jetting from the liquid droplets that form on a wire electrode as it exits a bath of liquid with an entrained liquid coating. For electrospraying of core-shell particle a new bath configuration with an immiscible two-layer liquid system may be used. The top liquid layer may be a polymer solution in a mixture of organic solvents and is used as the shell layer. The bottom layer may be an aqueous solution of a polymer and serves as the core. The top liquid has a lower density than the bottom layer so that the layering of the solutions was maintained throughout the experiments. The wire electrodes may be oriented parallel to the liquid surface. As it sweeps through the bath, it first entrains the bottom liquid and then the top liquid and thereby forming bi-layer core-shell droplets on the wire. Now, as the electric field is turned on, these core-shell droplets form Taylor cones and disintegrate into droplets which dry into core-shell particles as they reach the grounded collector at a distance.

Figure 2:
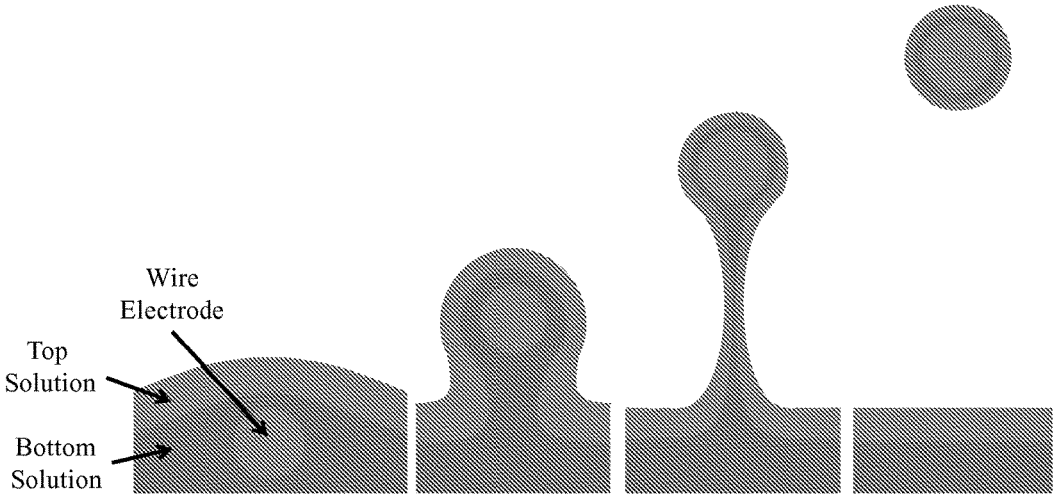
FIG. 2 depicts the evolution of the surface profiles of the two immiscible liquids as the wire (viewed end-on) travels through the liquid interfaces.

In the coaxial free surface electrospinning process, the liquids are layered such that as the wire sweeps through the bath, the bottom liquid first becomes entrained on the wire, and then the top liquid becomes entrained on and encapsulates the liquid-coated wire. This configuration leads to the formation of two annular films on the wire, wherein the bottom liquid coats the wire and the top liquid coats the bottom liquid. FIG. 2 shows the development of the annular bilayer film as the wire travels through the liquid bath. Due to the Plateau-Rayleigh instability, the annular bilayer film breaks up into individual droplets, each droplet containing both liquids such that the bottom liquid is encapsulated in a droplet of the top liquid on the metal wire.

To ensure a coaxial jet, the fluids are designed so that charge builds up at the interface between the two fluids, consistent with the leaky dielectric model. In the presence of the electric field, stresses are generated at the interface (e.g., buildup of free charge at the interface of the two solutions) that causes the electrohydrodynamic jet to form. The more viscous bottom (or inner) fluid jets through the top (or outer) fluid, resulting in a coaxial coating flow. If the charges accumulate instead at the surface of the top (or outer) fluid, the outer fluid jets first and must entrain the inner fluid to form a coaxial jet, but generally fails to do so due to the lower viscosity of the top fluid. For this reason, it is usually desirable that the conductivity and dielectric constant of the bottom fluid be greater than those of the top fluid, to ensure that charges build up at the fluid-fluid interface. The usual axially symmetric varicose instability or asymmetric whipping instability ensues, depending on the viscoelasticity of the fluids, so that either particles or fibers with the corresponding core/shell morphologies are obtained. In the absence of a nonvolatile solute in the bottom (or inner) fluid, the particles or fibers may be hollow.

Control of evaporation is an essential component of the process to ensure the desired core/shell morphology in the final particles or fibers. In the case of the coaxial jet, the solvent from the core must diffuse through the shell layer and then evaporate at the outer surface of the jet. If the solvent from the core does not diffuse through the shell before the shell solidifies, then the fibers may contain a large amount of voids, and/or form collapsed, ribbon-like fibers. To remedy this and enhance the mass transport of the core solvent through the shell solvent, the shell solvent may be designed to contain a co-solvent that is partially miscible with the core solvent. This facilitates transport of the core solvent through the shell. The jet solidifies as the solvents evaporate from the jet, resulting in the formation of fiber with the desired core-shell morphology.

Exemplary Methods

In certain embodiments, the invention relates to a method of forming a plurality of core-shell particles or a plurality of core-shell fibers, comprising the steps of:

applying an electric voltage to a cylindrical electrode;

drawing the cylindrical electrode through a first fluid, thereby forming a coated cylindrical electrode;

drawing the coated cylindrical electrode through a second fluid, wherein the first fluid is more viscous than the second fluid, thereby forming a bilayer-coated cylindrical electrode; and positioning the bilayer-coated cylindrical electrode at a distance from a grounded collection surface;

wherein the plurality of core-shell particles or the plurality of core-shell fibers is deposited on the grounded collection surface.

In certain embodiments, the invention relates to a method of forming a plurality of core-shell particles or a plurality of core-shell fibers, comprising the steps of:

applying an electric voltage to a cylindrical electrode;

drawing the cylindrical electrode through a first fluid, thereby forming a coated cylindrical electrode;

drawing the coated cylindrical electrode through a second fluid, wherein the first fluid is more viscous than the second fluid, thereby forming a bilayer-coated cylindrical electrode; and positioning the bilayer-coated cylindrical electrode at a distance from a grounded collection surface, wherein the axis of the bilayer-coated cylindrical electrode is substantially parallel to the grounded collection surface, thereby forming an electrified jet at the surface of the bilayer-coated cylindrical electrode;

wherein the electrified jet comprises a core layer and a shell layer; and the plurality of core-shell particles or the plurality of core-shell fibers is deposited on the grounded collection surface.

In certain embodiments, the invention relates to a method of forming a plurality of core-shell particles or a plurality of core-shell fibers, comprising the steps of:

applying an electric voltage to a cylindrical electrode;

contacting the cylindrical electrode with a first fluid, thereby forming a coated cylindrical electrode;

contacting the coated cylindrical electrode with a second fluid, wherein the first fluid is more viscous than the second fluid, thereby forming a bilayer-coated cylindrical electrode; and positioning the bilayer-coated cylindrical electrode at a distance from a grounded collection surface, wherein the axis of the bilayer-coated cylindrical electrode is substantially parallel to the grounded collection surface, thereby forming an electrified jet at the surface of the bilayer-coated cylindrical electrode;

wherein the electrified jet comprises a core layer and a shell layer; and the plurality of core-shell particles or the plurality of core-shell fibers is deposited on the grounded collection surface.

In certain embodiments, the invention relates to a method of forming a plurality of core-shell particles or a plurality of core-shell fibers, comprising the steps of:

contacting a cylindrical electrode with a first fluid, thereby forming a coated cylindrical electrode;

contacting the coated cylindrical electrode with a second fluid, wherein the first fluid is more viscous than the second fluid, thereby forming a bilayer-coated cylindrical electrode;

positioning the bilayer-coated cylindrical electrode at a distance from a grounded collection surface, wherein the axis of the bilayer-coated cylindrical electrode is substantially parallel to the grounded collection surface; and applying an electric voltage to the bilayer-coated cylindrical electrode, thereby forming an electrified jet at the surface of the bilayer-coated cylindrical electrode;

wherein the electrified jet comprises a core layer and a shell layer; and the plurality of core-shell particles or the plurality of core-shell fibers is deposited on the grounded collection surface.

In certain embodiments, the invention relates to any one of the aforementioned methods, wherein the density of the first fluid is greater than the density of the second fluid.

In certain embodiments, the invention relates to any one of the aforementioned methods, wherein the dielectric constant of the first fluid is greater than the dielectric constant of the second fluid.

In certain embodiments, the invention relates to any one of the aforementioned methods, wherein the electrical conductivity of the first fluid is greater than the electrical conductivity of the second fluid.

In certain embodiments, the invention relates to any one of the aforementioned methods, wherein the first fluid and the second fluid are substantially immiscible.

In certain embodiments, the invention relates to any one of the aforementioned methods, wherein the cylindrical electrode comprises an electrically conductive material.

In certain embodiments, the invention relates to any one of the aforementioned methods, wherein the cylindrical electrode comprises copper or stainless steel.

In certain embodiments, the invention relates to any one of the aforementioned methods, wherein the diameter of the cylindrical electrode is about 0.01 mm to about 10 cm. In certain embodiments, the invention relates to any one of the aforementioned methods, wherein the diameter of the cylindrical electrode is about 0.20 mm, about 0.22 mm, about 0.24 mm, about 0.26 mm, about 0.28 mm, about 0.30 mm, about 0.32 mm, about 0.34 mm, about 0.36 mm, about 0.38 mm, about 0.40 mm, about 0.42 mm, about 0.44 mm, about 0.46 mm, about 0.48 mm, about 0.50 mm, about 0.52 mm, about 0.54 mm, about 0.56 mm, about 0.58 mm, about 0.60 mm, about 0.62 mm, about 0.64 mm, about 0.66 mm, about 0.68 mm, about 0.70 mm, about 0.72 mm, about 0.74 mm, about 0.76 mm, about 0.78 mm, about 0.80 mm, about 0.82 mm, about 0.84 mm, about 0.86 mm, about 0.88 mm, about 0.90 mm, about 0.92 mm, about 0.94 mm, about 0.96 mm, about 0.98 mm, about 1 mm, about 1.1 mm, about 1.2 mm, about 1.3 mm, about 1.4 mm, about 1.5 mm, about 1.6 mm, about 1.7 mm, about 1.8 mm, about 1.9 mm, about 2 mm, about 3 mm, about 4 mm, about 5 mm, about 6 mm, about 7 mm, about 8 mm, about 9 mm, or about 10 mm.

In certain embodiments, the invention relates to any one of the aforementioned methods, wherein a plurality of cylindrical electrodes are arranged in parallel on a rotating spindle.

In certain embodiments, the invention relates to any one of the aforementioned methods, wherein the cylindrical electrode is wound helically around a rotating spindle.

In certain embodiments, the invention relates to any one of the aforementioned methods, wherein a plurality of cylindrical electrodes is configured as rings encircling the axis of a rotating spindle.

In certain embodiments, the invention relates to any one of the aforementioned methods, wherein the first fluid or the second fluid comprises a non-volatile component. In certain embodiments, the non-volatile component is a polymer, a small molecule, an active pharmaceutical agent, or a biological molecule.

In certain embodiments, the invention relates to any one of the aforementioned methods, wherein the circumference of the cylindrical electrode contacts the first fluid.

In certain embodiments, the invention relates to any one of the aforementioned methods, wherein the cylindrical electrode is drawn through the first fluid.

In certain embodiments, the invention relates to any one of the aforementioned methods, wherein the cylindrical electrode is drawn through the first fluid; and the axis of the cylindrical electrode is substantially parallel to the surface of the first fluid.

In certain embodiments, the invention relates to any one of the aforementioned methods, wherein the cylindrical electrode is drawn through the first fluid; and the axis of the cylindrical electrode is substantially perpendicular to the surface of the first fluid.

In certain embodiments, the invention relates to any one of the aforementioned methods, wherein the cylindrical electrode is drawn through the first fluid at a rate of about 0.1 mm/s to about 100 mm/s. In certain embodiments, the invention relates to any one of the aforementioned methods, wherein the cylindrical electrode is drawn through the first fluid at a rate of about 2 mm/s to about 30 mm/s. In certain embodiments, the invention relates to any one of the aforementioned methods, wherein the cylindrical electrode is drawn through the first fluid at a rate of about 4 mm/s to about 20 mm/s. In certain embodiments, the invention relates to any one of the aforementioned methods, wherein the cylindrical electrode is drawn through the first fluid at a rate of about 4 mm/s, about 5 mm/s, about 6 mm/s, about 7 mm/s, about 8 mm/s, about 9 mm/s, about 10 mm/s, about 11 mm/s, about 12 mm/s, about 13 mm/s, about 14 mm/s, about 15 mm/s, about 16 mm/s, about 17 mm/s, about 18 mm/s, about 19 mm/s, or about 20 mm/s.

In certain embodiments, the invention relates to any one of the aforementioned methods, wherein the first fluid comprises water.

In certain embodiments, the invention relates to any one of the aforementioned methods, wherein the first fluid comprises polyethylene oxide, polyethylene glycol, or polyvinylpyrrolidone.

In certain embodiments, the invention relates to any one of the aforementioned methods, wherein the first fluid comprises polyethylene oxide and polyethylene glycol. In certain embodiments, the invention relates to any one of the aforementioned methods, wherein the first fluid comprises polyethylene oxide and polyethylene glycol in a weight ratio of about 15:85, about 20:80, about 25:75, about 27:73, about 30:70, about 35:65, or about 40:60. In certain embodiments, the invention relates to any one of the aforementioned methods, wherein the first fluid comprises about 1.5, about 2.0, about 2.5, about 3.0, about 3.5, about 4.0, about 4.5, or about 5.0 wt % polyethylene oxide. In certain embodiments, the invention relates to any one of the aforementioned methods, wherein the first fluid comprises about 4.0, about 4.5, about 5.0, about 5.5, about 6.0, about 6.5, about 7.0, about 7.5, about 8.0, about 8.5, about 9.0, about 9.5, about 10.0, about 10.5, about 11.0, about 11.5, or about 12.0 wt % polyethylene glycol. In certain embodiments, the invention relates to any one of the aforementioned methods, wherein the first fluid comprises about 3.75 wt % polyethylene oxide and about 8.25 wt % polyethylene glycol.

In certain embodiments, the invention relates to any one of the aforementioned methods, wherein the first fluid comprises polyethylene oxide and water. In certain embodiments, the invention relates to any one of the aforementioned methods, wherein the first fluid comprises about 5 wt % polyethylene oxide and water.

In certain embodiments, the invention relates to any one of the aforementioned methods, wherein the first fluid comprises polyethylene glycol and water.

In certain embodiments, the invention relates to any one of the aforementioned methods, wherein the first fluid comprises polyvinylpyrrolidone and water. In certain embodiments, the invention relates to any one of the aforementioned methods, wherein the first fluid comprises about 8 wt % polyvinylpyrrolidone and water. In certain embodiments, the invention relates to any one of the aforementioned methods, wherein the first fluid comprises about 15 wt % polyvinylpyrrolidone and water.

In certain embodiments, the invention relates to any one of the aforementioned methods, wherein the first fluid comprises about 5, about 10, about 15, about 20, or about 25 wt % polyvinylpyrrolidone.

In certain embodiments, the invention relates to any one of the aforementioned methods, wherein the molecular weight of the polyethylene oxide is about 150, about 200, about 250, about 300, about 350, about 400, or about 450 kDa.

In certain embodiments, the invention relates to any one of the aforementioned methods, wherein the molecular weight of the polyethylene glycol is about 15, about 20, about 25, about 30, about 35, about 40, about 45, about 50, or about 55 kDa.

In certain embodiments, the invention relates to any one of the aforementioned methods, wherein the molecular weight of the polyvinylpyrrolidone is about 150, about 200, about 250, about 300, about 350, about 400, about 450, about 500, about 550, about 600, about 650, about 700, about 750, about 800, about 850, about 900, or about 950 kDa. In certain embodiments, the invention relates to any one of the aforementioned methods, wherein the molecular weight of the polyvinylpyrrolidone is about 1.0, about 1.1, about 1.2, about 1.3, about 1.4, about 1.5, about 1.6, about 1.7, about 1.8, about 1.9, or about 2.0 MDa. In certain embodiments, the invention relates to any one of the aforementioned methods, wherein the molecular weight of the polyvinylpyrrolidone is about 360 kDa or about 1.3 MDa.

In certain embodiments, the invention relates to any one of the aforementioned methods, wherein the first fluid further comprises an active agent. In certain embodiments, the invention relates to any one of the aforementioned methods, wherein the active agent is acetaminophen.

In certain embodiments, the invention relates to any one of the aforementioned methods, wherein the first fluid further comprises an active agent in about 2, about 3, about 4, about 5, about 6, about 7, or about 8 wt %.

In certain embodiments, the invention relates to any one of the aforementioned methods, wherein the density of the first fluid is greater than about 1.0 g/mL. In certain embodiments, the invention relates to any one of the aforementioned methods, wherein the density of the first fluid is about 1.01 g/mL, about 1.02 g/mL, about 1.03 g/mL, about 1.04 g/mL, about 1.05 g/mL, about 1.06 g/mL, about 1.07 g/mL, about 1.08 g/mL, about 1.09 g/mL, about 1.1 g/mL, about 1.12 g/mL, about 1.14 g/mL, about 1.16 g/mL, about 1.18 g/mL, about 1.2 g/mL, about 1.22 g/mL, about 1.24 g/mL, about 1.26 g/mL, about 1.28 g/mL, about 1.3 g/mL, about 1.32 g/mL, about 1.34 g/mL, about 1.36 g/mL, about 1.38 g/mL, or about 1.4 g/mL.

In certain embodiments, the invention relates to any one of the aforementioned methods, wherein the conductivity of the first fluid is about 0.5 μS/cm to about 125 μS/cm. In certain embodiments, the invention relates to any one of the aforementioned methods, wherein the conductivity of the first fluid is greater than about 1.0 μS/cm. In certain embodiments, the invention relates to any one of the aforementioned methods, wherein the conductivity of the first fluid is about 3, about 4, about 5, about 6, about 7, about 8, about 9, about 10, about 15, about 20, about 25 ,about 30, about 35, about 40, about 45, about 50, about 55, about 60, about 65, about 70, about 75, about 80, about 85, about 90, about 95, about 100, about 110, or about 120 μS/cm.

In certain embodiments, the invention relates to any one of the aforementioned methods, wherein the viscosity of the first fluid is about 50 to about 800 mPa·s. In certain embodiments, the invention relates to any one of the aforementioned methods, wherein the viscosity of the first fluid is about 50, about 60, about 70, about 80, about 90, about 100, about 125, about 150, about 175, about 200, about 225, about 250, about 275, about 300, about 325, about 350, about 375, about 400, about 425, about 450, about 475, about 500, about 525, about 550, about 575, about 600, about 625, about 650, about 675, or about 700 mPa·s.

In certain embodiments, the invention relates to any one of the aforementioned methods, wherein the circumference of the coated cylindrical electrode contacts the second fluid.

In certain embodiments, the invention relates to any one of the aforementioned methods, wherein the coated cylindrical electrode is drawn through the second fluid.

In certain embodiments, the invention relates to any one of the aforementioned methods, wherein the coated cylindrical electrode is drawn through the second fluid; and the axis of the coated cylindrical electrode is substantially parallel to the surface of the second fluid.

In certain embodiments, the invention relates to any one of the aforementioned methods, wherein the coated cylindrical electrode is drawn through the second fluid; and the axis of the coated cylindrical electrode is substantially perpendicular to the surface of the second fluid.

In certain embodiments, the invention relates to any one of the aforementioned methods, wherein the coated cylindrical electrode is drawn through the second fluid at a rate of about 0.1 mm/s to about 100 mm/s. In certain embodiments, the invention relates to any one of the aforementioned methods, wherein the coated cylindrical electrode is drawn through the second fluid at a rate of about 2 mm/s to about 30 mm/s. In certain embodiments, the invention relates to any one of the aforementioned methods, wherein the coated cylindrical electrode is drawn through the second fluid at a rate of about 4 mm/s to about 20 mm/s. In certain embodiments, the invention relates to any one of the aforementioned methods, wherein the coated cylindrical electrode is drawn through the second fluid at a rate of about 4 mm/s, about 5 mm/s, about 6 mm/s, about 7 mm/s, about 8 mm/s, about 9 mm/s, about 10 mm/s, about 11 mm/s, about 12 mm/s, about 13 mm/s, about 14 mm/s, about 15 mm/s, about 16 mm/s, about 17 mm/s, about 18 mm/s, about 19 mm/s, or about 20 mm/s.

In certain embodiments, the invention relates to any one of the aforementioned methods, wherein the density of the second fluid is about 0.8 g/mL to about 1 g/mL. In certain embodiments, the invention relates to any one of the aforementioned methods, wherein the density of the second fluid is about 0.87 g/mL to about 0.97 g/mL. In certain embodiments, the invention relates to any one of the aforementioned methods, wherein the density of the second fluid is about 0.85, about 0.86, about 0.87, about 0.88, about 0.89, about 0.90, about 0.91, about 0.92, about 0.93, about 0.94, about 0.95, about 0.96, about 0.97, about 0.98, or about 0.99 g/mL.

In certain embodiments, the invention relates to any one of the aforementioned methods, wherein the conductivity of the second fluid is about 0 to about 0.01 μS/cm.

In certain embodiments, the invention relates to any one of the aforementioned methods, wherein the viscosity of the second fluid is about 2 mPa·s to about 300 mPa·s. In certain embodiments, the invention relates to any one of the aforementioned methods, wherein the viscosity of the second fluid is about 2.8 mPa·s to about 190 mPa·s. In certain embodiments, the invention relates to any one of the aforementioned methods, wherein the viscosity of the second fluid is about 2, about 4, about 6, about 8, about 10, about 15, about 20, about 25, about 30, about 35, about 40, about 45, about 50, about 55, about 60, about 65, about 70, about 75, about 80, about 85, about 90, about 95, about 100, about 110, about 120, about 130, about 140, about 150, about 160, about 170, about 180, about 190, about 200, about 210, about 220, about 230, about 240, about 250, about 260, about 270, about 280, or about 290 mPa·s.

In certain embodiments, the invention relates to any one of the aforementioned methods, wherein the second fluid comprises polystyrene. In certain embodiments, the invention relates to any one of the aforementioned methods, wherein the second fluid comprises polystyrene in about 5 wt %, 10 wt %, about 20 wt %, about 30 wt %, about 35 wt %, about 40 wt %, about 45 wt %, about 50 wt %, about 55 wt %, about 60 wt %, about 65 wt %, or about 70 wt %.

In certain embodiments, the invention relates to any one of the aforementioned methods, wherein the second fluid comprises ethyl cellulose. In certain embodiments, the invention relates to any one of the aforementioned methods, wherein the second fluid comprises a solution of ethyl cellulose, wherein the solution of ethyl cellulose has a viscosity of about 4 cP, a concentration of about 5 wt % in toluene:ethanol (80:20), and about 48% ethoxy labeling. In certain embodiments, the second fluid comprises about 3 wt %, about 4 wt %, about 5 wt %, about 6 wt %, about 7 wt %, about 8 wt %, about 9 wt %, about 10 wt %, about 11 wt %, about 12 wt %, about 13 wt %, about 14 wt %, about 15 wt %, about 16 wt %, about 17 wt %, about 18 wt %, about 19 wt %, or about 20 wt % of the solution of ethyl cellulose.

In certain embodiments, the invention relates to any one of the aforementioned methods, wherein the second fluid comprises n-butanol. In certain embodiments, the invention relates to any one of the aforementioned methods, wherein the second fluid comprises mesitylene. In certain embodiments, the invention relates to any one of the aforementioned methods, wherein the second fluid comprises n-butanol and mesitylene. In certain embodiments, the invention relates to any one of the aforementioned methods, wherein the second fluid comprises n-butanol and mesitylene in a ratio of about 5:95, about 10:90, about 15:85, about 20:80, about 25:75, about 30:70, about 35:65, about 40:60, about 45:55, about 50:50, about 55:45, about 60:40, about 65:35, about 70:30, about 75:25, about 80:20, about 85:15, about 90:10, or about 95:5 by weight.

In certain embodiments, the invention relates to any one of the aforementioned methods, wherein the second fluid comprises polystyrene, n-butanol, and mesitylene.

In certain embodiments, the invention relates to any one of the aforementioned methods, wherein the molecular weight of the polystyrene is about 15, about 20, about 25, about 30, about 35, about 40, about 45, about 50, or about 55 kDa.

In certain embodiments, the invention relates to any one of the aforementioned methods, wherein the second fluid comprises amylbenzene. In certain embodiments, the invention relates to any one of the aforementioned methods, wherein the second fluid comprises n-butanol and amylbenzene. In certain embodiments, the invention relates to any one of the aforementioned methods, wherein the second fluid comprises n-butanol and amylbenzene in a ratio of about 20:80, about 25:75, about 30:70, about 35:65, about 40:60, about 45:55, about 50:50, about 55:45, about 60:40, about 65:35, about 70:30, or about 75:25 by weight.

In certain embodiments, the invention relates to any one of the aforementioned methods, wherein the second fluid comprises hexylbenzene. In certain embodiments, the invention relates to any one of the aforementioned methods, wherein the second fluid comprises n-butanol and hexylbenzene. In certain embodiments, the invention relates to any one of the aforementioned methods, wherein the second fluid comprises n-butanol and hexylbenzene in a ratio of about 20:80, about 25:75, about 30:70, about 35:65, about 40:60, about 45:55, about 50:50, about 55:45, about 60:40, about 65:35, about 70:30, about 75:25, about 80:20, about 85:15, or about 90:10 by weight.

In certain embodiments, the invention relates to any one of the aforementioned methods, wherein the second fluid comprises n-propanol. In certain embodiments, the invention relates to any one of the aforementioned methods, wherein the second fluid comprises n-propanol and mesitylene. In certain embodiments, the invention relates to any one of the aforementioned methods, wherein the second fluid comprises n-propanol and mesitylene in a ratio of about 10:90, about 15:85, about 20:80, about 25:75, or about 30:70 by weight.

In certain embodiments, the invention relates to any one of the aforementioned methods, wherein the second fluid comprises a compatibilizing agent. In certain embodiments, the compatibilizing agent facilitates transport of the solvent in the first fluid through the second fluid. In certain embodiments, the compatibilizing agent is at least partially miscible with both the first fluid and the second fluid.

In certain embodiments, the invention relates to any one of the aforementioned methods, wherein the viscoelasticity of the first fluid and the second fluid dictate whether core-shell particles or core-shell fibers are formed. For example, if the electrified jet has a low viscoelasticity, core-shell particles will be formed. If the electrified jet comprises highly viscoelastic fluids, core-shell fibers will be formed.

In certain embodiments, the invention relates to any one of the aforementioned methods, wherein the electrified jets cool to form core-shell particles or core-shell fibers.

In certain embodiments, the invention relates to any one of the aforementioned methods, wherein a solvent in the electrified jets evaporates, thereby forming the core-shell particles or the core-shell fibers.

In certain embodiments, the invention relates to any one of the aforementioned methods, wherein the electric voltage is about 1 kV to about 100 kV. In certain embodiments, the invention relates to any one of the aforementioned methods, wherein the electric voltage is about 13 kV, about 14 kV, about 15 kV, about 16 kV, about 17 kV, about 18 kV, about 19 kV, about 20 kV, about 21 kV, about 22 kV, about 23 kV, about 24 kV, about 25 kV, about 26 kV, about 27 kV, about 28 kV, about 29 kV, about 30 kV, about 31 kV, about 32 kV, about 33 kV, about 34 kV, about 35 kV, about 36 kV, about 37 kV, about 38 kV, about 39 kV, about 40 kV, about 41 kV, about 42 kV, about 43 kV, about 44 kV, about 45 kV, about 46 kV, about 47 kV, about 48 kV, about 49 kV, about 50 kV, about 51 kV, about 52 kV, about 53 kV, about 54 kV, about 55 kV, about 56 kV, about 57 kV, or about 58 kV.

In certain embodiments, the invention relates to any one of the aforementioned methods, wherein the ratio of conductivity of the first fluid to conductivity of the second fluid is about 50:1 to about 100,000:1. In certain embodiments, the invention relates to any one of the aforementioned methods, wherein the ratio of conductivity of the first fluid to conductivity of the second fluid is greater than about 100:1. In certain embodiments, the invention relates to any one of the aforementioned methods, wherein the ratio of conductivity of the first fluid to conductivity of the second fluid is greater than about 1000:1.

In certain embodiments, the invention relates to any one of the aforementioned methods, wherein the first fluid and the second fluid are in a container.

In certain embodiments, the invention relates to any one of the aforementioned methods, further comprising the step of applying an electric voltage to the container. In certain embodiments, the invention relates to any one of the aforementioned methods, wherein the electric voltage is about 1 kV to about 100 kV. In certain embodiments, the invention relates to any one of the aforementioned methods, wherein the electric voltage is about 13 kV, about 14 kV, about 15 kV, about 16 kV, about 17 kV, about 18 kV, about 19 kV, about 20 kV, about 21 kV, about 22 kV, about 23 kV, about 24 kV, about 25 kV, about 26 kV, about 27 kV, about 28 kV, about 29 kV, about 30 kV, about 31 kV, about 32 kV, about 33 kV, about 34 kV, about 35 kV, about 36 kV, about 37 kV, about 38 kV, about 39 kV, about 40 kV, about 41 kV, about 42 kV, about 43 kV, about 44 kV, about 45 kV, about 46 kV, about 47 kV, about 48 kV, about 49 kV, about 50 kV, about 51 kV, about 52 kV, about 53 kV, about 54 kV, about 55 kV, about 56 kV, about 57 kV, or about 58 kV. In certain embodiments, the invention relates to any one of the aforementioned methods, wherein the electric voltage applied to the cylindrical electrode and the electric voltage applied to the container are substantially equal.

In certain embodiments, the invention relates to any one of the aforementioned methods, wherein a plurality of electrified jets are formed.

In certain embodiments, the invention relates to any one of the aforementioned methods, wherein the grounded collection surface is a grounded collection plate, a grounded rotating drum, a grounded rotating wheel, or a grounded conveyor belt.

In certain embodiments, the invention relates to any one of the aforementioned methods, wherein the distance between the bilayer-coated cylindrical electrode and the grounded collection surface is about 1 to about 100 centimeters. In certain embodiments, the invention relates to any one of the aforementioned methods, wherein the distance between the bilayer-coated cylindrical electrode and the grounded collection surface is about 20 cm, about 21 cm, about 22 cm, about 23 cm, about 24 cm, about 25 cm, about 26 cm, about 27 cm, about 28 cm, about 29 cm, about 30 cm, about 31 cm, about 32 cm, about 33 cm, about 34 cm, about 35 cm, about 36 cm, about 37 cm, about 38 cm, about 39 cm, or about 40 cm.

In certain embodiments, the invention relates to any one of the aforementioned methods, wherein the grounded collection surface comprises various geometries (e.g., rectangular, circular, triangular, etc.), rotating drum/rod, wire mesh, air gaps, or other 3-D collectors including spheres, pyramids, etc.

In certain embodiments, the invention relates to any one of the aforementioned methods, wherein the core-shell particles or core-shell fibers are deposited at a rate of greater than 0.1 g/h.

Exemplary Particles and Fibers

In certain embodiments, the invention relates to a core-shell particle or a core-shell fiber made by any one of the aforementioned methods.

In certain embodiments, the invention relates to a core-shell particle made by any one of the aforementioned methods. In certain embodiments, the core-shell particles have a diameter of about 1 nm to about 10 μm. In certain embodiments, the diameter of the core-shell particle is about 200 nm to about 1000 nm. In certain embodiments, the diameter of the core-shell particle is about 250 nm, about 275 nm, about 300 nm, about 325 nm, about 350 nm, about 375 nm, about 400 nm, about 425 nm, about 450 nm, about 475 nm, about 500 nm, about 525 nm, about 550 nm, about 575 nm, about 600 nm, about 625 nm, or about 650 nm.

In certain embodiments, the invention relates to a core-shell fiber made by any one of the aforementioned methods. In certain embodiments, the core-shell fibers have a long length, an ultrathin diameter, and capability of being aligned on the molecular level. In certain embodiments, the core-shell fibers possess many exceptional properties, such as, for example, high mechanical strength, high surface area, and other tunable mechanical, surface, electrical, thermal, and/or chemical properties, depending on the selection of the polymers and morphology of the generated electrospun fibers.

In certain embodiments, the core-shell fibers have at least one dimension, e.g., a width or diameter, of about 1 nm to about 10 μm. In certain embodiments, the core-shell fibers are ultra-fine and can provide a high weight loading when taken collectively. In certain embodiments, the diameter of the core-shell fiber is about 200 nm to about 1000 nm. In certain embodiments, the diameter of the core-shell fiber is about 250 nm, about 275 nm, about 300 nm, about 325 nm, about 350 nm, about 375 nm, about 400 nm, about 425 nm, about 450 nm, about 475 nm, about 500 nm, about 525 nm, about 550 nm, about 575 nm, about 600 nm, about 625 nm, or about 650 nm.

In certain embodiments, the shell of the core-shell fibers has at least one dimension, e.g., a width or diameter, of about 1 nm to about 5 μm. In certain embodiments, the thickness of the shell is about 1 nm to about 1000 nm. In certain embodiments, the thickness of the shell is about 10 nm, about 20 nm, about 30 nm, about 40 nm, about 50 nm, about 60 nm, about 70 nm, about 80 nm, or about 90 nm.

Exemplary Non-Woven Materials

In certain embodiments, the invention relates to a non-woven material comprising a plurality of the above-mentioned core-shell fibers. In certain embodiments, the non-woven materials have uniform, well-controlled surface morphology. In certain embodiments, non-woven materials have tunable properties including, but not limited to, mechanical robustness, surface properties, and/or electrical-, thermal-, and/or chemical properties.

In certain embodiments, the non-woven materials have desirable surface energy.

In certain embodiments, the non-woven materials have desirable mechanical properties, e.g., tensile strength, elongation %, toughness, or initial modulus.

In certain embodiments, the non-woven materials have desirable thermal diffusivity.

EXEMPLIFICATION

The invention now being generally described, it will be more readily understood by reference to the following examples, which are included merely for purposes of illustration of certain aspects and embodiments of the invention, and are not intended to limit the invention.

Example 1

Experiments were carried out using solutions of 300 kDa polyethylene oxide (PEO) and 35 kDa polyethylene glycol (PEG), 360 kDa polyvinylpyrrolidone (PVP) or 1.3 MDa PVP in deionized (DI) water as the bottom fluid, and 35 kDa polystyrene (PS) in mixtures of n-butanol and mesitylene as the top fluid. All chemical and solvents (except for DI water) were obtained from Sigma Aldrich. The solution conductivity was measured using a VWR Digital Conductivity Meter. The liquid-liquid interfacial surface tensions were estimated by a reciprocal solubility method and values of liquid-vapor surface tensions were obtained from the literature. The viscosity was determined using an AGR2 Rheometer (TA instruments).

To perform experiments, the liquid bath was first partially filled with the aqueous bottom fluid, and then the top organic fluid was added to the bath. The top organic fluid is of lower density than the bottom aqueous fluid in all cases, so that layering of the fluids in the bath is maintained throughout the experiment. The working distance of 30 to 35 cm was set between the grounded collection plate and the wire electrode; this distance allows enough time for the majority of the solvents to evaporate from the liquid jet before impaction on the collector. At shorter working distances, the jets were not sufficiently solidified to retain the desired core/shell morphology after impaction on the collector, for these particular solvents. The rotation rate of the spindle combined with the radius of the spindle determines the velocity of the wire as it passes through the liquid bath. This rate was controlled in the range from 2.5-12 rpm by a small DC motor. For a spindle diameter of 3.2 cm, this corresponds to a wire velocity in the range from 4 -20 mm/s. The applied voltage was controlled by a Gamma High voltage power supply (RR40-1.5). The applied voltage ranged from 30 to 38.5 kV. Both the liquid bath and wire electrode were connected to the high voltage power supply to ensure reliable electrical connection to the liquid bath. It is important to note that solution aging (i.e., change of composition due to evaporation of solvent from the surface of the bath) does not play a significant role in these systems because the top fluid consists of n-butanol and mesitylene, which have relatively low vapor pressures relative to other commonly used solvents for electrospinning, such as ethanol, methanol or water. Nevertheless, for the examples reported here, coaxial free surface electrospinning experiments were limited to periods of 20 min.

After coaxial electrospinning, the composition of the electrospun fibers was determined by UV-Vis spectrometry. The fibrous mats were examined with scanning electron microscopy (SEM) to study fiber morphology. A simple mass transfer model was developed to explain the fiber morphology. In addition, SEM micrographs of fractured fibers and transmission electron micrographs (TEM) of individual electrospun fibers confirm the desired core-shell fiber morphology. Fiber diameters were measured with ImageJ software.

To determine the relative amounts of entrained fluids on the wire electrodes, UV-Vis spectrometry was used to determine the mass fraction of polystyrene, $x_T$, in the final (PEO+PEG)/PS or PVP/PS core/shell fibers. Here, it is assumed that the composition of the core/shell fiber is representative of the entrained annular bilayer film on the wire electrode. PS is UV active at a wavelength 260 nm, where PEO, PEG and PVP are not UV active. Standard solutions were prepared to determine the relationship between PS concentration and UV absorption at 260 nm. Diluted solutions of polystyrene and polyethylene oxide were prepared by dissolving the (PEO+PEG)/PS fibers in dichloromethane (DCM). The volume fraction $v_B$ of the bottom fluid in the entrained bilayer was determined by the following equation $$v_B = \left[1 + \frac{C_B \rho_B^f x_T}{C_T \rho_T^f (1 - x_T)}\right]^{-1} \quad \text{Eq. 1}$$

where $C_i$ and $\rho_i^f$ are the concentration in weight percent and bulk fluid density, respectively, of solution i, where i=T and i=B denote top and bottom fluids, respectively.

Taking advantage of the relationship, $h \sim Ca^b$, and assuming that the thickness of the entrained bilayer film ($h_B+h_T$) is small compared to the radius of the wire, the volume fraction of the bottom fluid on the wire can be expressed as a function of the capillary numbers of the top and bottom fluids:

$$v_B \approx \frac{h_B}{h_B + h_T} = \left[1 + \left(\frac{Ca_T}{Ca_B}\right)^b\right]^{-1} \quad \text{Eq. 2}$$

Note that according to eq. 2, the volume fraction of the bottom fluid entrained on the wire is independent of the velocity (or rotation rate) of the spindle.

Figure 3:
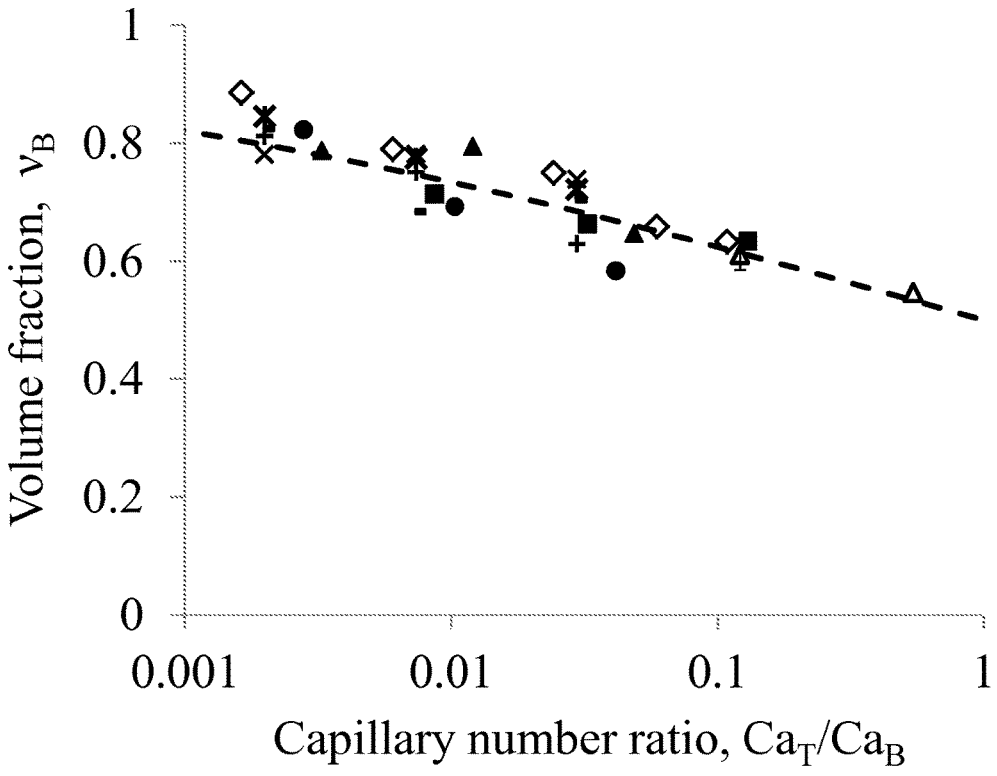
FIG. 3 is a graph showing that the volume fraction of the bottom fluid in the entrained bilayer films is a function of the ratio of the capillary numbers of the two fluids. The dashed lines follow the relation given by Equation 2, where the wire is drawn parallel (b=0.22) to the free surface. The open symbols were obtained from experiments in which the bottom fluid was 8 wt % 1.3 MDa PVP (triangles) or 15 wt % 360 kDa PVP (diamonds) in deionized (DI) water with top fluids of varying concentrations of 35 kDa PS in a 35:65 mixture (by weight) of n-butanol and mesitylene. The filled symbols were obtained from experiments in which the bottom fluid was 12 wt % PEG+PEO (a 73:27 mixture by weight of 35 kDa PEG and 300 kDa PEO) in DI water with top fluids of varying concentrations of 35 kDa PS in pure mesitylene (squares), a 10:90 mixture of n-butanol:mesitylene (triangles) or a 20:80 mixture of n-butanol: mesitylene (circles). In all of these cases, the rotation rate was 5.6 rpm. The remaining symbols are experiments with a bottom fluid of 12wt % PEG+PEO (the 73:27 mixture) in DI water and top fluid of 10, 20, and 30 wt % of 35 kDa PS in the 35:65 mixture of n-butanol:mesitylene at rotation rates of 2.5 rpm (×), 5.6 rpm (+), 8.9 rpm (−) or 11.8 rpm (*).

FIG. 3 shows the volume fraction of the bottom fluid in the entrained bilayer film, from UV-Vis measurements and eq 1, as a function of the capillary ratio, $Ca_T/Ca_B$ (where $Ca_T$ and $Ca_B$ are the capillary numbers of the top and bottom fluids, respectively). As the capillary ratio increases, the entrained bilayer film becomes increasingly enriched in the top fluid. FIG. 3 confirms that the composition of the entrained fluid has no dependence on the rotation rate of the wire spindle. The composition of the final electrospun fibers can be controlled simply by altering the fluid properties as described.

Figure 4:
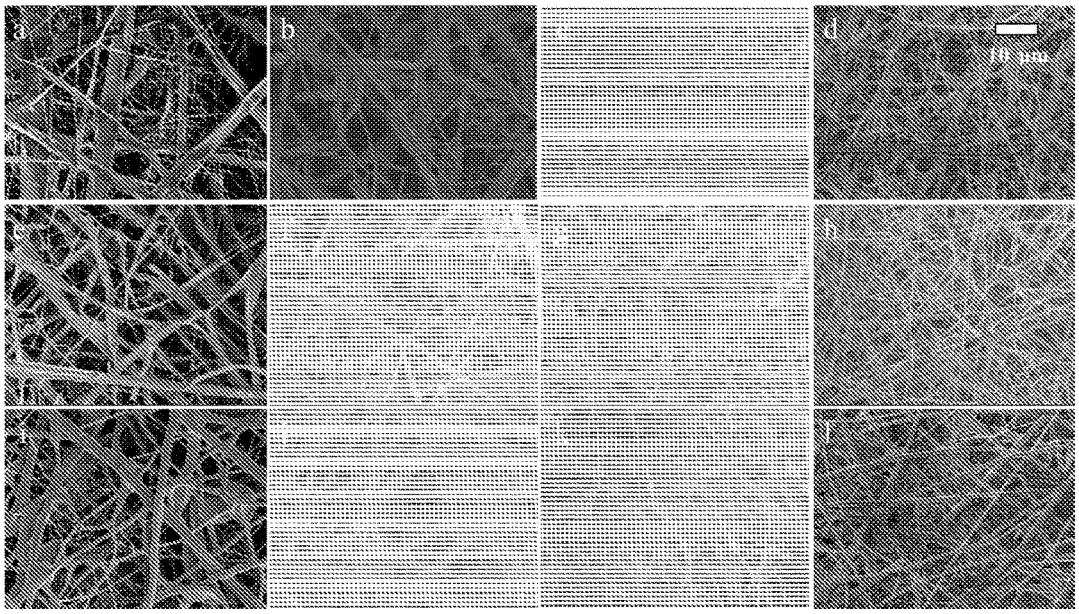
FIG. 4 depicts scanning electron micrographs of fiber mats produced by coaxial free surface electrospinning The core fluid was 12 wt % PEO+PEG (73:27 wt mixture) in DI water and the shell fluid was 10 wt % 35 kDa PS (a, b, c, d), 20 wt % 35 kDa PS (e, f, g, h) or 30 wt % 35 kDa PS (i, j, k, l). The shell solvent compositions were pure mesitylene (a, e, i), a 10:90 mixture (by weight) of n-butanol:mesitylene (b, f, j), a 20:80 mixture (by weight) of n-butanol:mesitylene (c, g, k) or a 35:65 mixture (by weight) of n-butanol: mesitylene (d, h, l).

FIG. 4 illustrates the importance to the final fiber morphology of the addition of the co-solvent n-butanol to the shell fluid. As the concentration of n-butanol in the shell fluid is increased (from left to right in FIG. 4) the deposited fiber mats change in appearance from highly fused, irregular and ribbon-like filaments to more uniform, smaller diameter fibers.

Figure 5:
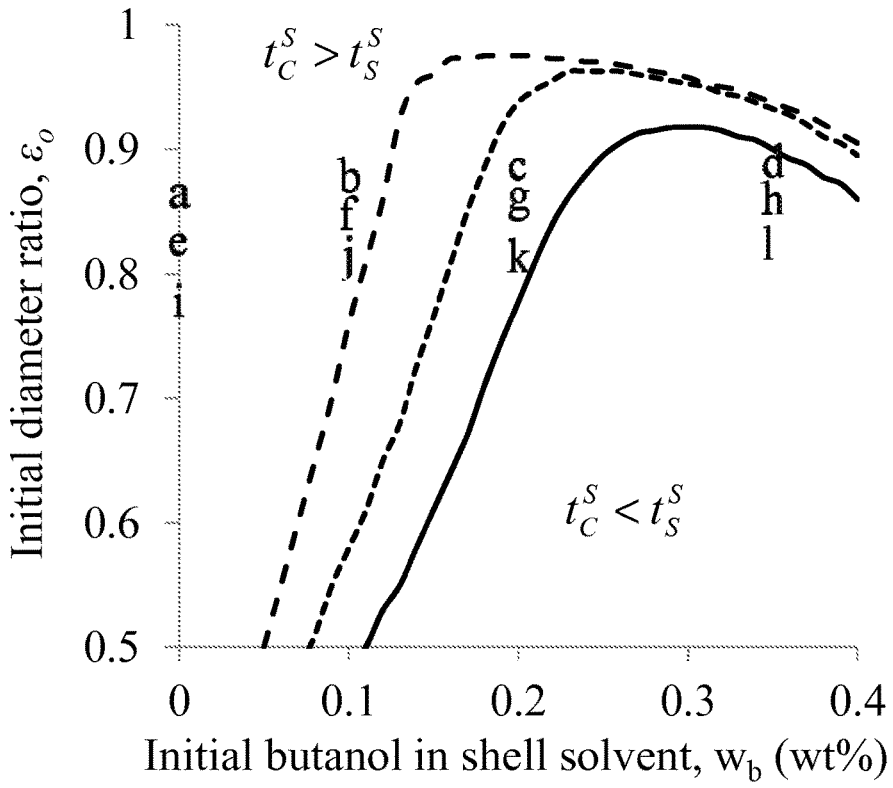
FIG. 5 is a graph showing fiber morphology as predicted by the proposed mass transport model. Above the lines represents the case when the shell solidifies before the core. Similarly, below the lines represents the case when the core solidifies before the shell. Each line represents different shell concentrations: 10 wt % 35 kDa PS (long dash), 20 wt % 35 kDa PS (short dash) and 30 wt % 35 kDa PS (solid line). The symbols represent the experiments presented in FIG. 4 where the shell fluid was 10 wt % 35 kDa PS (a, b, c, d), 20 wt % 35 kDa PS (e, f, g, h) or 30 wt % 35 kDa PS (i, j, k, l). The shell solvent compositions were pure mesitylene (a, e, i), a 10:90 mixture (by weight) of n-butanol:mesitylene (b, f, j), a 20:80 mixture (by weight) of n-butanol:mesitylene (c, g, k) or a 35:65 mixture (by weight) of n-butanol:mesitylene (d, h, l).

To explain these observations, a simple mass transport model is proposed in which the core solvent (water) diffuses through the shell fluid, which is primarily a mixture of mesitylene and n-butanol. All solvents evaporate at the outermost surface of the cylindrical jet. As evaporation takes place, the respective volumes of the core and shell fluids (and hence also the diameters of the core and shell) decrease until solidification occurs. Solidification is assumed to occur when either fluid reaches a polymer concentration of 90 wt %. The ratio of the diameters of the core and shell fluids is denoted $\epsilon_0$. Assuming that the composition (by volume) of the entrained bilayer on the wire electrodes is the same as that of the coaxial jets, the initial ratio of diameters of the core and shell fluids, $\epsilon_0$, can estimated to be $\epsilon_0 = v_B^{1/2}$. The model determines the relative times of solidification of the core, $t_C^S$, and shell, $t_S^S$. $t_C^S > t_S^S$ is indicates that the shell layer solidifies first, producing ribbons or collapsed fibers. However, is $t_S^S > t_C^S$ indicates that the core solidifies first, producing the desirable solid coaxial fibers. FIG. 5 shows the model results for a system whose core is 12 wt % PEO+PEG (73:27 wt mixture) in DI water and whose shell is 10, 20 or 30 wt % 35 kDa PS in n-butanol:mesitylene mixture with increasing n-butanol concentration.

Collapsed fibers were produced in systems where the solvent concentration of n-butanol was 10 wt % or less (a, b, e, f, i and j in FIG. 4 and FIG. 5), and also in the system with 30 wt % PS in 20:80 n-butanol:mesitylene (k in FIG. 4 and FIG. 5). In these systems, the shell layer solidified before the core solidified, as predicted by the mass transport model (data points are above their corresponding line in FIG. 5). The viscosity of the polystyrene solutions remained relatively constant with varying weight fractions of n-butanol, but increased with increasing concentration of polystyrene. As a result, the initial diameter ratio is relatively constant for a given PS shell concentration and varying n-butanol concentration in the shell fluid. However, increasing the n-butanol concentration enhances the solubility of the water in the shell solvent, which increases the mass transport of the water solvent through the shell layer, allowing the core to solidity before the shell.

The mass transport model also helps to explain why mesitylene is suitable as the primary solvent in the organic phase, compared to other solvents in which PS is soluble (such as toluene, benzene, xylene, and dichloromethane). For systems in which the primary solvent in the top fluid was toluene or another highly volatile solvent, the shell solidifies before all the water is able to diffuse across the shell and evaporate from the outer surface of the coaxial jet. By choosing a primary solvent like mesitylene with a low vapor pressure, the shell layer remains a liquid for long enough time to allow for the water to completely evaporate from the coaxial jet and produce core-shell fibers.

Figures 6, 7:
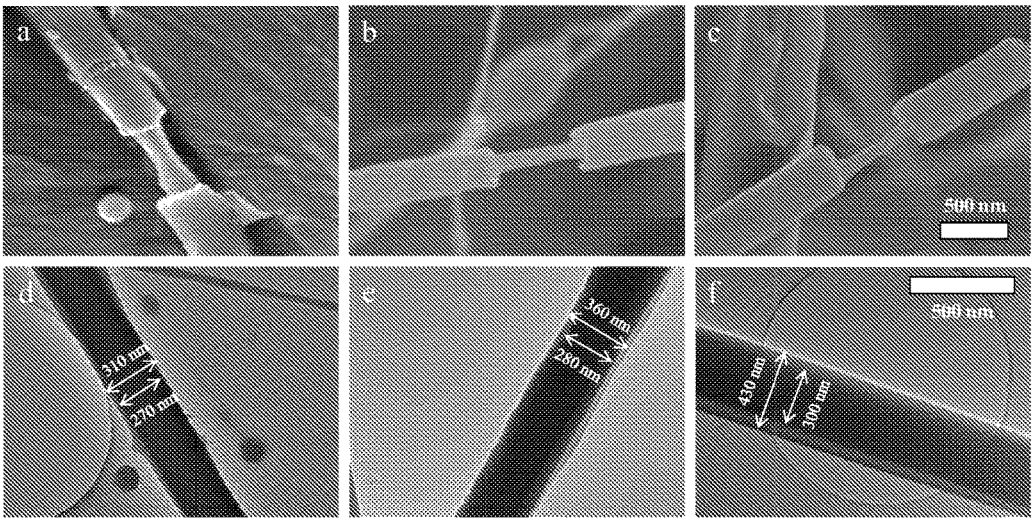
FIG. 6 depicts (top row): Scanning electron micrographs of (PEO+PEG)/PS fibers in which the brittle PS shell has been fractured to show the elastic core. From left to right, the images show fibers spun from bottom solutions of increasing 35 kDa PS concentration in 35:65 mixtures of n-butanol: mesitylene. a) 10 wt % PS; b) 20 wt % PS; c) 30 wt % PS. (bottom row): Transmission electron micrographs of (PEO+PEG)/PS fibers in which Cu(II)Cl has been added (for contrast) to the bottom solution. From left to right, the images show fibers spun from bottom solutions of increasing 35 kDa PS concentration in 35:65 mixtures of n-butanol: mesitylene. d) 10 wt % PS; e) 20 wt % PS; f) 30 wt % PS.
FIG. 7 tabulates the average diameter fiber, and ratio of core diameter to final fiber diameter [(PEG+PEO)/PS] where the bottom fluid was 12 wt % PEO+PEG (73:27 wt mixture) in DI water, and the top fluid was 10, 20 or 30 wt % 35 kDa PS.
Figure 8:
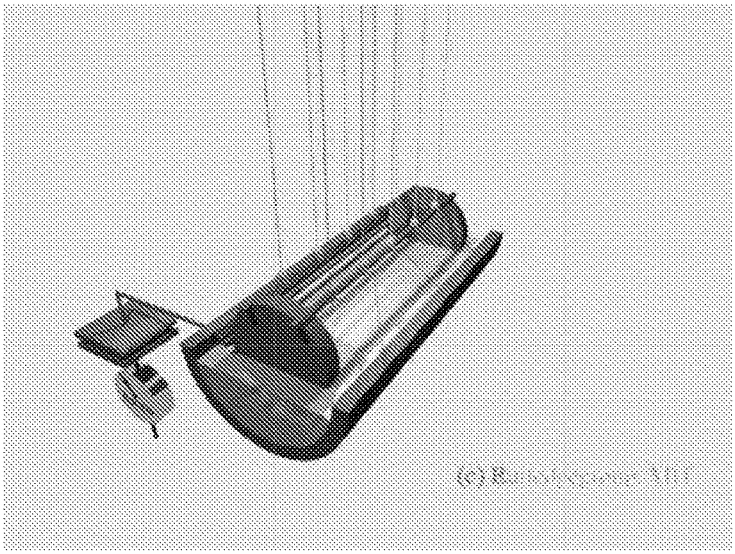
FIG. 8 depicts free surface electrospinning from a wire electrode
Figure 9:
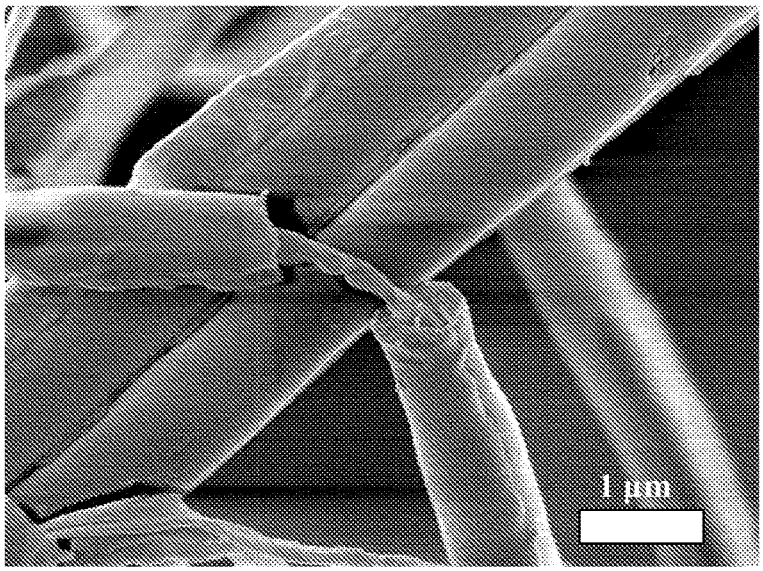
FIG. 9 depicts a scanning electron micrograph of coaxial free surface electrospun fibers. The core filament is clearly evident in places where the shell has been broken.

FIG. 6 shows the scanning electron micrographs (SEM) and transmission electron micrographs (TEM) of individual fibers produced by the coaxial free surface electrospinning technology, confirming the core/shell morphology. The SEMs show fibers in which the brittle PS shell has been fractured, exposing the elastic PEO+PEG core. The TEMs show fibers that were produced with the addition of 0.2 wt % of copper (II) chloride to the bottom solution. The copper (II) chloride acts as a contrast agent in the TEMs, revealing the distinct core and shell components of the fibers thus produced. As the viscosity and concentration of the top solution increases, the thickness of the shell increases, in accord with the results shown in FIG. 3.

The diameters of the core and shell were measured with ImageJ. The average fiber diameters of (PEO+PEG)/PS fiber are shown in FIG. 7, where the bottom fluid was a 12 wt % PEG+PEO (a 73:27 mixture by weight of 35 kDa PEG and 300 kDa PEO) in DI water, and the top fluids were varying concentrations of 35 kDa PS in 35:65 wt of n-butanol and mesitylene. From the TEM images, the ratio of core diameter to final fiber diameter, $\epsilon_\infty$, was measured and calculated. With increase weight percent of PS in the shell, the thickness of the shell layer increases. Utilizing eq. 2, the core diameter to final fiber diameter ratio can be estimated by eq. 3

$$\varepsilon_\infty = \left[1 + \frac{\rho_B^p \rho_T^f C_T}{\rho_T^p \rho_B^f C_B}\left(\frac{Ca_T}{Ca_B}\right)^b\right]^{-1/2} \quad \text{Eq. 3}$$

where $\rho_i^P$ is the density of the bulk polymer i. The density of the PEG, PEO and PS are estimated to be 1.1 g/mL. The $\epsilon_\infty^{exp}$ is slightly lower than the predicted value $\epsilon_\infty^{theor}$, this may be due to a some amount of voids in the shell layers causing the experimentally observed shell diameter to be larger than would be the case if the shell were void-free. It is important to note that eq. 3 is strictly dependent on the fluid and material properties. This relationship allows for the possibility to choose fluid properties to produce a desired fiber morphology.

Fibers with core-shell morphology may be produced by means of coaxial free surface electrospinning from a wire electrode. By altering the capillary ratio and solution concentrations, it is possible to control the shell thickness of the coaxial fibers. A model has been developed to describe the evaporation of solvents from the coaxial jet, the results of which correlate well with the observed morphology of the electrospun fibers. Both, SEM and TEM images confirm the formation of the core/shell fibers morphology.

Example 2

Solution Configurations

FIG. 10 shows the properties of the polymer solutions used during this study. The viscosity was determined using an AGR2 Rheometer (TA instruments) and the conductivity was determined using a portable conductivity meter (VWR). The surface tension of the n-butanol and mesitylene mixture was estimated based on reported literature values. It is common practice to assume that the surface tension of polymeric solution is approximately the same as the surface tension of the pure solvent. The interfacial surface tension was estimated by the reciprocal solubility method. D. J. Donahue, F. E. Bartell, The Boundary Tension at Water-Organic Liquid Interface, *J. Phys. Chem.,* 1952, 56, 480-484.

Polymers

Multiple configurations were investigated in this study. FIGS. 12-15 show lists of the solutions which were successful in producing core-shell fibers. There experiments were performed at a working distances of 30 cm, at applied voltage of 30-34 kV and a rotation rate of 5.6 rpm with a straight wire 200 micron thick stainless steel electrode.

System Configurations

Figure 17:
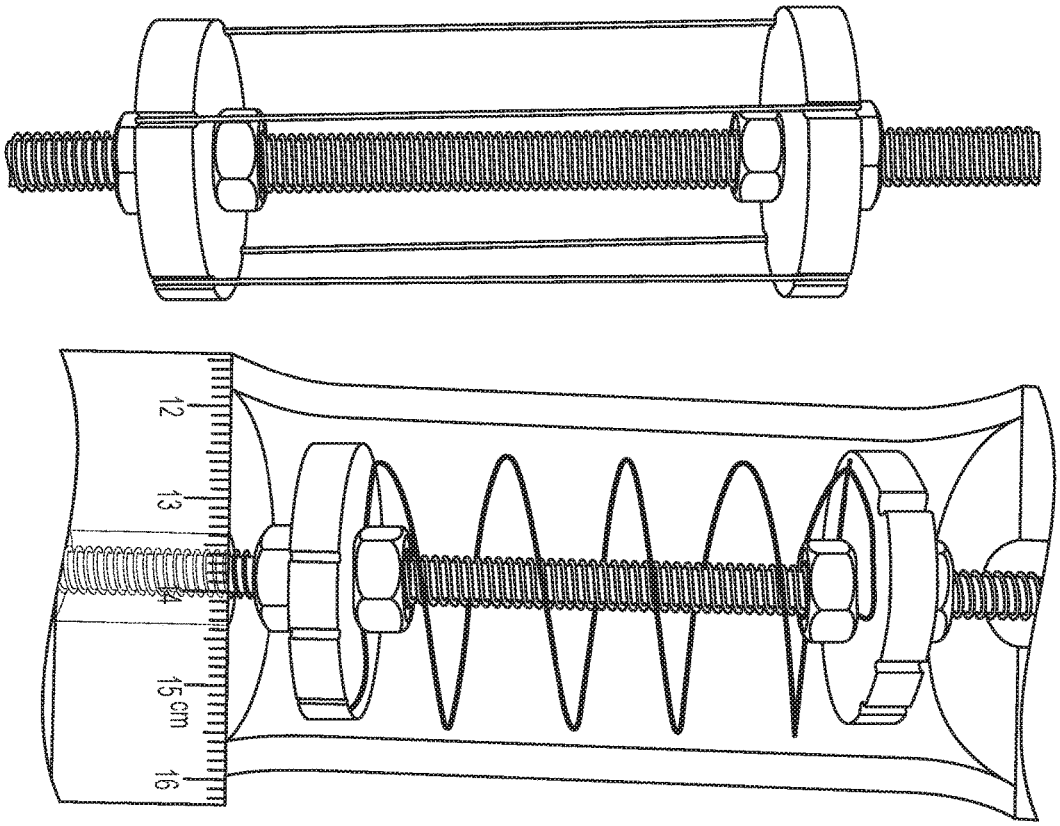
FIG. 17 depicts (top) straight parallel wires electrode with 32 gauge stainless steel wire; and (bottom) helix electrode with 32 gauge copper wire.
Figure 18:
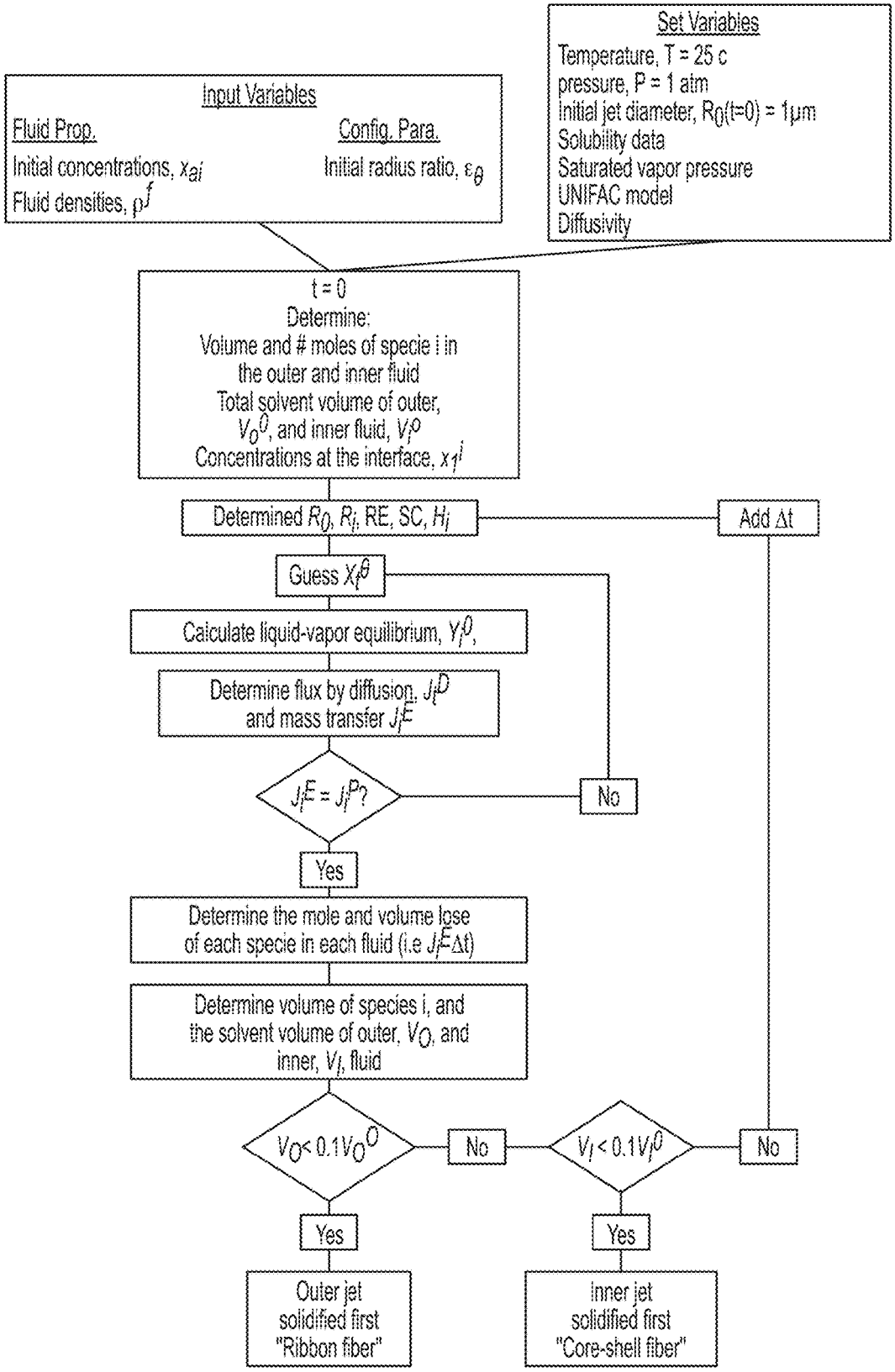
FIG. 18 depicts a flow diagram of an exemplary computation routine.
Figure 19:
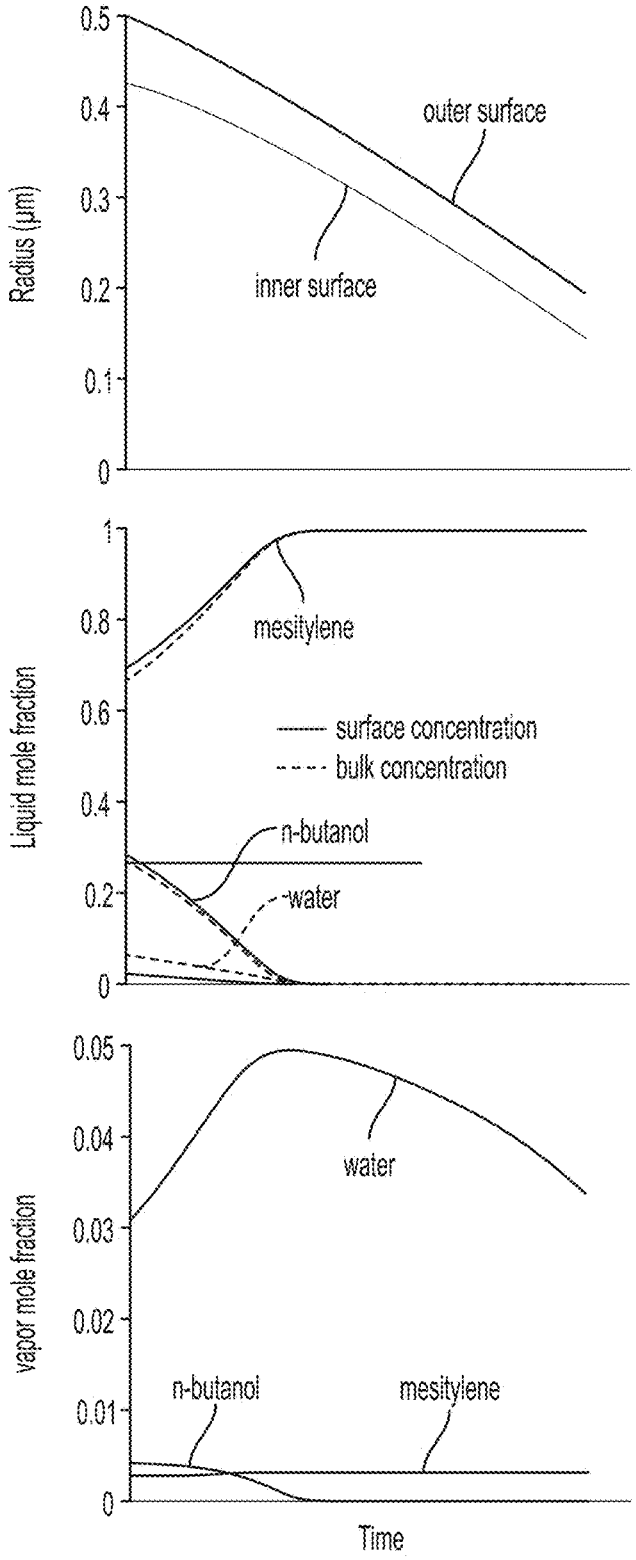
FIG. 19 depicts model results for the system where the top liquid was 20 wt % PS in 20:80 wt % n-butanol:mesitylene and the bottom liquid was 12 wt % PEG+PEO (73:27 wt % mixture) in DI water. (top) Variation in core and shell radii, $R_1$ and $R_O$, respectively, with time as solvents evaporate from the jet. (middle) Mole fractions of solvents in the shell phase as functions of time. "surface" refers to the concentration at RO, where evaporation occurs and "bulk" refers to average mole fraction of solvent in the shell phase. (bottom) Mole fractions of solvent in the vapor immediately in contact with the jet. This vapor is assumed to be in equilibrium with the liquid at the jet surface.

Different electrode shapes were studied. These experiments were investigated with a bottom solution of 12 wt % (8.75 wt % 35 kDa PEG and 3.25 wt % 300 kDa PEO) and a top solution of 30 wt % 35 kDa PS in 35:65 n-butanol: mesitylene. These experiments were performed at a working distances of 30 cm, at applied voltage of 30-34 kV and a rotation rate of 5.6 rpm. Both the straight parallel wires electrode with a wire thickness of 0.2 mm and helix wire electrodes with wire thicknesses of 1-13 mm have been studied in detail. Both stainless steel and copper wires were used in this study, and there appears to be no difference in behavior between them. See FIG. 16 and FIG. 17.

Rotation Rate

A range of rotation rates of 2.5 rpm to 11 rpm with spindle diameter of 32 mm was successful for producing core-shell fibers.

Working Distance

Due to the low volatility of water and the shell solvent, a working distance greater than 25 cm is typically required to allow sufficient time for the jet to solidify.

Applied Voltage

A sufficient applied voltage was required to effectively produce the onset of electrospinning, typically 25 kV or greater applied voltage was required.

Example 3

Materials and Methods:

To demonstrate core-shell electrospraying process, a pair of core and shell solutions was used. An aqueous solution of 10 kDa polyethylene glycol with a concentration of 22 wt % was used as the bottom or core solution. The top solution consisted of 10 wt % 35 kDa polystyrene in mesitylene and butanol mixture (mesitylene: butanol with 65:35 wt/wt ratio). All chemicals and solvents were obtained from Sigma Aldrich.

To allow enough drying time for the liquid droplets to form dry particles, the distance between the wire electrode and the grounded collector was kept at 28 to 32 cm. The rotation rate of the spindle was controlled in the range of 1-1.5 rpm by a small DC motor. This corresponds to a linear velocity of 3.3-5 mm/sec. The applied voltage was controlled by a Gamma high voltage power supply and ranged from 28-35 kV. Although aging of the liquids was not significant due to the low boiling points of the solvents in the top solution, the experiments were limited to 10 mins span.

Results and Discussion:

In certain embodiments, in order to achieve electrospraying instead of electrospinning, lower molecular weights or lower concentrations are used. In this example, 10 kDa molecular weight was chosen for polyethylene glycol which ensured particle formation even at high concentration. In case of electrospinning, even at 12 wt % of solute concentration of PEG/PEO in water, a complete evaporation of solvent through the shell layer could be achieved. In case of electrospraying, a total PEG concentration of 22 wt % in the core layer was used which decreases the amount of solvent in the core layer. Thus, a complete evaporation of core solvent through the shell layer should occur within the flight time of the droplets given the same solvent composition of the shell layer. Keeping the same concentration of PS (10 wt %) in the shell layer, fibers were formed during electrospinning, whereas particles can be formed during electrospray as we transition to a lower molecular weight of PEG as the core solute. It indicates that the viscoelasticity of the core solution plays a role in deciding whether fibers or particles would be generated.

Figure 22:
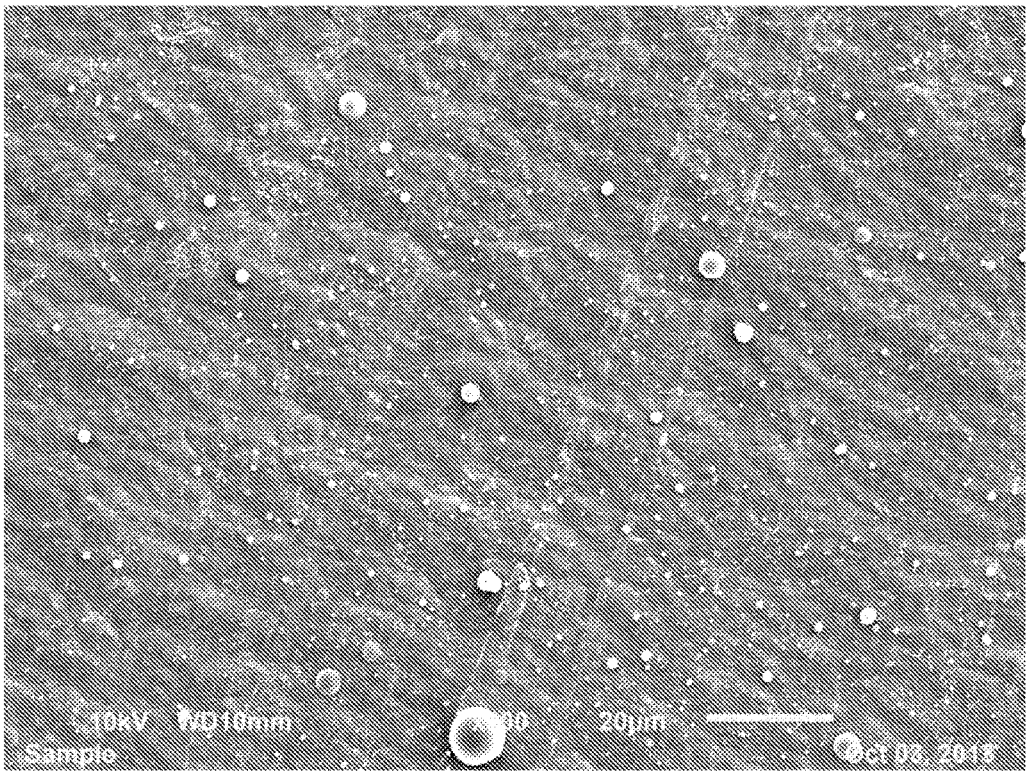
FIG. 22 depicts a SEM image of core-shell particles formed on a grounded Al foil collector.
Figure 23:
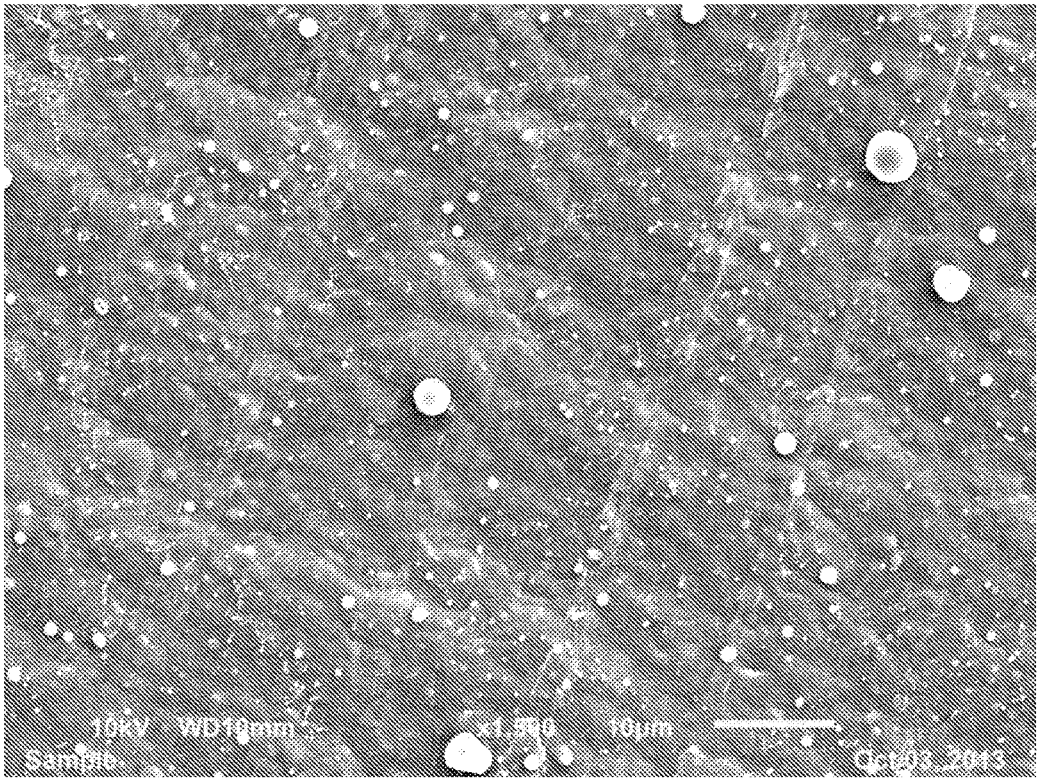
FIG. 23 depicts a SEM image of core-shell particles formed on a grounded Al foil collector.
Figure 24:
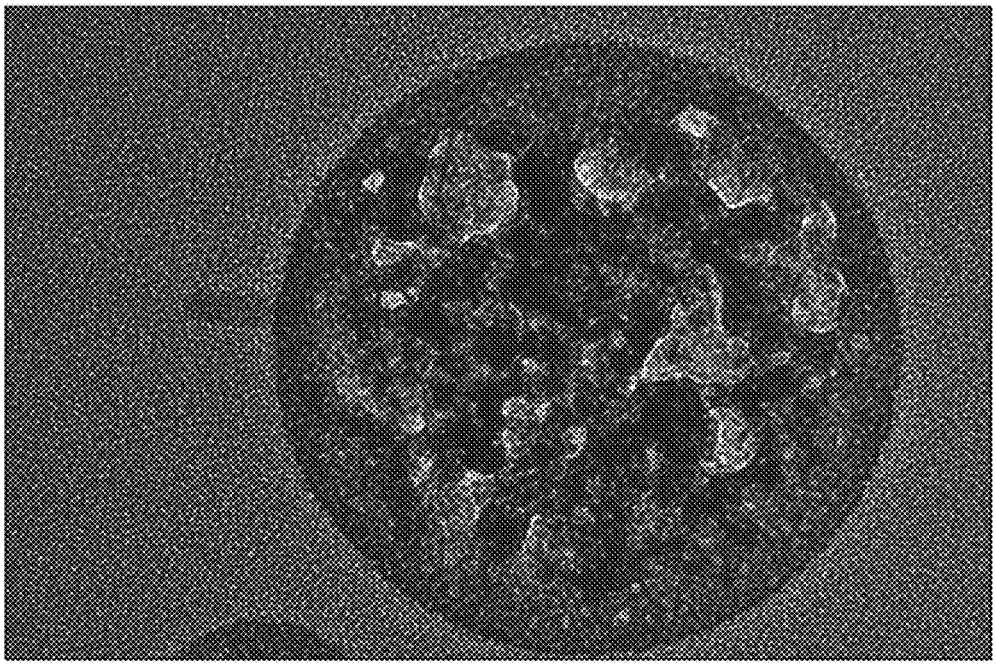
FIG. 24 depicts a TEM image of core-shell particles. The core solution contained 2.5 wt % $CuSO_4$ as contrast agent. $CuSO_4$ crystals were formed in the core as observed from TEM. The core solution contained 22 wt % 10 kDa PEG in water and the shell solution contained 10 wt % 35 kDa PS in 35:65 mixtures of n-butanol:mesitylene. The arrows indicate the shell layer.
Figure 25:
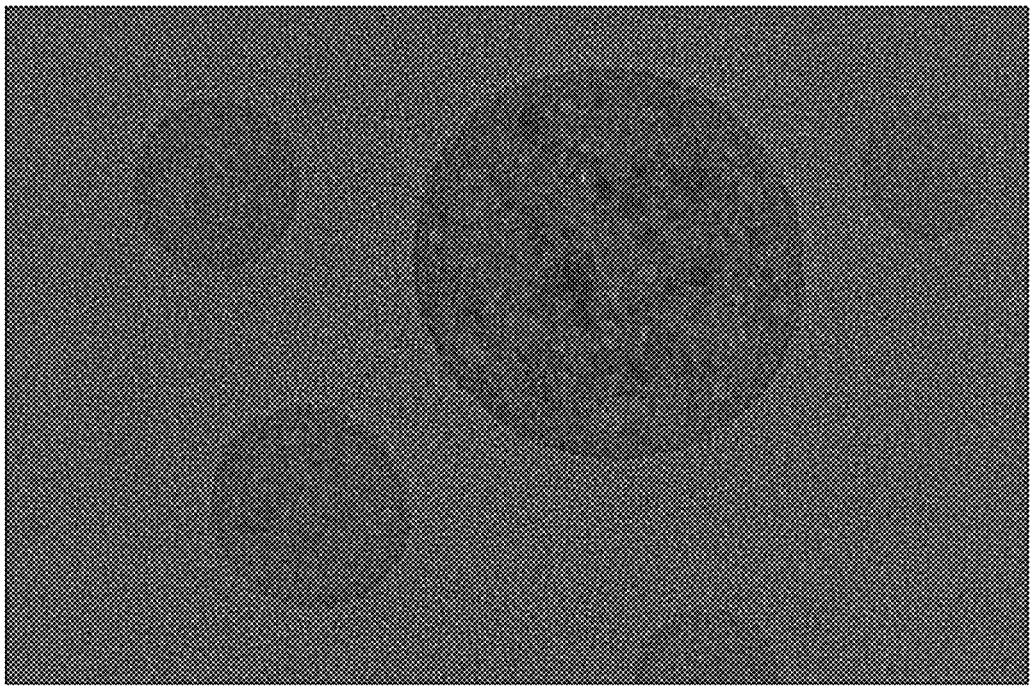
FIG. 25 depicts a TEM image of core-shell particles. The core solution contained 2.5 wt % $CuSO_4$ as contrast agent. $CuSO_4$ crystals were formed in the core as observed from TEM. The core solution contained 22 wt % 10 kDa PEG in water and the shell solution contained 10 wt % 35 kDa PS in 35:65 mixtures of n-butanol:mesitylene.

SEM images (FIGS. 22 and 23) of the samples confirm the electrosprayed particle formation on the collector. The sizes of the particles range from tens of nanometers to couple of microns. TEM images (FIGS. 24 and 25) also confirm the core-shell particle formation. However, with only 10 wt % of PS, the shell layer is thin and sometimes difficult to see under TEM.

INCORPORATION BY REFERENCE

All of the U.S. patents and U.S. published patent applications cited herein are hereby incorporated by reference.

EQUIVALENTS

Those skilled in the art will recognize, or be able to ascertain using no more than routine experimentation, many equivalents to the specific embodiments of the invention described herein. Such equivalents are intended to be encompassed by the following claims.

We claim:

1. A method of forming a plurality of core-shell particles or a plurality of core-shell fibers, comprising the steps of:

applying an electric voltage to a cylindrical electrode;

drawing the cylindrical electrode through a first fluid, thereby forming a coated cylindrical electrode;

drawing the coated cylindrical electrode through a second fluid, wherein the first fluid is more viscous than the second fluid, thereby forming a bilayer-coated cylindrical electrode; and positioning the bilayer-coated cylindrical electrode at a distance from a grounded collection surface;

wherein the plurality of core-shell particles or the plurality of core-shell fibers is deposited on the grounded collection surface.

2. The method of claim 1, wherein the density of the first fluid is greater than the density of the second fluid.

3. The method of claim 1, wherein the dielectric constant of the first fluid is greater than the dielectric constant of the second fluid.

4. The method of claim 1, wherein the electrical conductivity of the first fluid is greater than the electrical conductivity of the second fluid.

5. The method of claim 1, wherein the cylindrical electrode comprises copper or stainless steel.

6. The method of claim 1, wherein a plurality of cylindrical electrodes are arranged in parallel on a rotating spindle.

7. The method of claim 1, wherein the cylindrical electrode is wound helically around a rotating spindle.

8. The method of claim 1, wherein a plurality of cylindrical electrodes are configured as rings encircling the axis of a rotating spindle.

9. The method of claim 1, wherein the first fluid or the second fluid comprises a non-volatile component.

10. The method of claim 9, wherein the non-volatile component is a polymer, a small molecule, an active pharmaceutical agent, or a biological molecule.

11. The method of claim 1, wherein the first fluid comprises water, polyethylene oxide, or polyvinylpyrrolidone.

12. The method of claim 1, wherein the first fluid further comprises an active agent.

13. The method of claim 1, wherein the density of the first fluid is about 1.0 g/mL to about 1.4 g/mL.

14. The method of claim 1, wherein the conductivity of the first fluid is about 0.5 μS/cm to about 125 μS/cm.

15. The method of claim 1, wherein the viscosity of the first fluid is about 50 to about 800 mPa·s.

16. The method of claim 1, wherein the density of the second fluid is about 0.8 g/mL to about 1 g/mL.

17. The method of claim 1, wherein the conductivity of the second fluid is about 0 to about 0.01 μS/cm.

18. The method of claim 1, wherein the viscosity of the second fluid is about 2 mPa·s to about 300 mPa·s.

19. The method of claim 1, wherein the second fluid comprises polystyrene, ethyl cellulose, n-propanol, n-butanol, mesitylene, amylbenzene, hexylbenzene, or a combination thereof.

20. The method of claim 1, wherein the ratio of conductivity of the first fluid to conductivity of the second fluid is about 50:1 to about 100,000:1.

21. The method of claim 1, wherein the first fluid and the second fluid are substantially immiscible.

* * * * *